US009164438B2

(12) United States Patent
Samei et al.

(10) Patent No.: US 9,164,438 B2
(45) Date of Patent: Oct. 20, 2015

(54) FIXING DEVICE TEMPERATURE CONTROL METHOD, FIXING DEVICE, AND IMAGE FORMING APPARATUS

(71) Applicants: Masahiro Samei, Osaka (JP); Yasunori Ishigaya, Kanagawa (JP); Ryota Yamashina, Kanagawa (JP); Takumi Waida, Kanagawa (JP)

(72) Inventors: Masahiro Samei, Osaka (JP); Yasunori Ishigaya, Kanagawa (JP); Ryota Yamashina, Kanagawa (JP); Takumi Waida, Kanagawa (JP)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 14/061,962

(22) Filed: Oct. 24, 2013

(65) Prior Publication Data

US 2014/0133877 A1 May 15, 2014

(30) Foreign Application Priority Data

Nov. 14, 2012 (JP) ..... 2012-250041

(51) Int. Cl.
*G03G 15/20* (2006.01)

(52) U.S. Cl.
CPC ..... *G03G 15/2042* (2013.01)

(58) Field of Classification Search
CPC ..... G03G 15/2042
See application file for complete search history.

(56) References Cited

U.S. PATENT DOCUMENTS 5,561,512 A * 10/1996 Fukano et al. ..... 399/69
6,011,939 A * 1/2000 Martin ..... 399/69
2008/0212991 A1 9/2008 Nakamura
2009/0297199 A1 12/2009 Yamashina et al.
2010/0008683 A1 1/2010 Yoshikawa
2010/0061754 A1 3/2010 Ishigaya et al.
2011/0052224 A1 3/2011 Yamashina et al.
2011/0064437 A1 3/2011 Yamashina et al.
2011/0091226 A1 4/2011 Ishigaya et al.
2011/0182634 A1 7/2011 Ishigaya et al.
2011/0206402 A1* 8/2011 Yamashina ..... 399/69
2011/0222927 A1 9/2011 Yamashina
2011/0299899 A1 12/2011 Ishigaya et al.
2012/0093532 A1 4/2012 Ishigaya et al.
2012/0093534 A1 4/2012 Waida et al.

(Continued)

FOREIGN PATENT DOCUMENTS

JP 61-128665 8/1986
JP 7-225524 8/1995

(Continued)

OTHER PUBLICATIONS

U.S. Appl. No. 13/864,320, filed Apr. 17, 2013, Masahiro Samei, et al.

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A fixing device temperature control method includes selectively energizing at least one of a plurality of heaters that heats a fixing rotary body according to an image area on a recording medium where a toner image is formed on the recording medium, detecting a temperature of a pressing rotary body pressed against the fixing rotary body, and controlling the energized, at least one of the plurality of heaters based on the detected temperature of the pressing rotary body so as to heat the fixing rotary body to a target temperature. The image area on the recording medium corresponds to a plurality of axial heating spans on the fixing rotary body.

16 Claims, 19 Drawing Sheets

(56) References Cited

U.S. PATENT DOCUMENTS

| | | | |
|---|---|---|---|
| 2012/0148287 | A1 | 6/2012 | Samei et al. |
| 2012/0148317 | A1 | 6/2012 | Samei et al. |
| 2012/0201547 | A1 | 8/2012 | Yamashina |
| 2012/0243895 | A1 | 9/2012 | Samei et al. |
| 2013/0051876 | A1 | 2/2013 | Ishigaya et al. |
| 2013/0202322 | A1 | 8/2013 | Waida et al. |
| 2013/0209120 | A1 | 8/2013 | Namekata et al. |
| 2013/0209122 | A1 | 8/2013 | Yamashina et al. |
| 2013/0209123 | A1 | 8/2013 | Waida et al. |
| 2013/0209124 | A1 | 8/2013 | Saito et al. |
| 2013/0209126 | A1 | 8/2013 | Seo et al. |
| 2013/0209127 | A1 | 8/2013 | Fujimoto et al. |
| 2013/0209128 | A1 | 8/2013 | Saito et al. |

FOREIGN PATENT DOCUMENTS

| | | |
|---|---|---|
| JP | 8-137341 | 5/1996 |
| JP | 8-146814 | 6/1996 |
| JP | 9-096991 | 4/1997 |
| JP | 2006-195422 | 7/2006 |
| JP | 2008-116820 | 5/2008 |
| JP | 2008-139780 | 6/2008 |
| JP | 2009-031651 | 2/2009 |
| JP | 2010-019870 | 1/2010 |
| JP | 2012-103667 | 5/2012 |

* cited by examiner

FIXING DEVICE TEMPERATURE CONTROL METHOD, FIXING DEVICE, AND IMAGE FORMING APPARATUS

CROSS-REFERENCE TO RELATED APPLICATION

This patent application is based on and claims priority pursuant to 35 U.S.C. §119 to Japanese Patent Application No. 2012-250041, filed on Nov. 14, 2012, in the Japanese Patent Office, the entire disclosure of which is hereby incorporated by reference herein.

BACKGROUND

1. Technical Field

Example embodiments generally relate to a fixing device temperature control method, a fixing device, and an image forming apparatus, and more particularly, to a fixing device temperature control method performed by a fixing device for fixing a toner image on a recording medium, the fixing device, and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotary body, such as a fixing roller and a fixing belt, and a pressing roller pressed against the fixing rotary body to form a fixing nip therebetween through which a recording medium bearing a toner image is conveyed. As the recording medium passes through the fixing nip, the fixing rotary body heated by a heater and the pressing roller apply heat and pressure to the recording medium to melt and fix the toner image on the recording medium.

The image forming apparatuses incorporating such a fixing device are required to form the toner image on various types of the recording media such as coated and uncoated paper and thin and thick paper. Additionally, the low-speed image forming apparatuses may convey fewer recording media at low speed and may be turned off after printing. Conversely, the high-speed image forming apparatuses may convey more recording media at high speed continuously. Under those conditions, the fixing device incorporated in such image forming apparatuses is required to achieve a desired fixing quality consistently.

To address this requirement, the image forming apparatus may change one or more image forming conditions for forming the toner image according to information about the recording medium input by a user, as disclosed by JP-H08-137341-A.

Alternatively, the fixing device may change a fixing condition for fixing the toner image on the recording medium according to information about the recording medium such as the surface property, the thickness, and the moisture content of the recording medium, as disclosed by JP-2006-195422-A.

At the same time, to save energy, the fixing device may be configured so as to not control the temperature of the pressing roller that does not contact an unfixed toner image. However, if the temperature of the pressing roller is not controlled during a print job, fluctuation in the temperature of the pressing roller may adversely affect fixing quality. For example, since the fixing rotary body is heated sufficiently to achieve the desired fixing quality even if the temperature of the pressing roller is relatively high, the pressing roller may overheat, which in turn overheats the recording medium. Accordingly, without controlling the temperature of the pressing roller, the temperature of the recording medium may fluctuate, varying fixing quality and wasting energy.

SUMMARY

At least one embodiment provides a novel fixing device temperature control method performed by a fixing device including a fixing rotary body, a plurality of heaters, a pressing rotary body, and a temperature detector. The fixing rotary body contacts and heats an unfixed toner image formed on a recording medium. The plurality of heaters is aligned in a longitudinal direction of the fixing rotary body to heat the fixing rotary body and disposed opposite a plurality of axial heating spans on the fixing rotary body, respectively. The pressing rotary body is pressed against the fixing rotary body to form a fixing nip between the fixing rotary body and the pressing rotary body through which the recording medium is conveyed. The temperature detector is disposed opposite the pressing rotary body to detect a temperature of the pressing rotary body. The fixing device temperature control method includes selectively energizing at least one of the plurality of heaters according to an image area on the recording medium where the toner image is formed on the recording medium. The image area corresponds to the plurality of axial heating spans on the fixing rotary body. The fixing device temperature control method further includes detecting the temperature of the pressing rotary body and controlling the energized, at least one of the plurality of heaters based on the detected temperature of the pressing rotary body so as to heat the fixing rotary body to a target temperature.

At least one embodiment provides a novel fixing device that includes a fixing rotary body, a plurality of heaters, a pressing rotary body, a temperature detector, a drive circuit, and a fixing temperature controller. The fixing rotary body contacts and heats an unfixed toner image formed on a recording medium. The plurality of heaters is aligned in a longitudinal direction of the fixing rotary body to heat the fixing rotary body and disposed opposite a plurality of axial heating spans on the fixing rotary body, respectively. The pressing rotary body is pressed against the fixing rotary body to form a fixing nip between the fixing rotary body and the pressing rotary body through which the recording medium is conveyed. The temperature detector is disposed opposite the pressing rotary body to detect a temperature of the pressing rotary body. The drive circuit is connected to the plurality of heaters to energize the plurality of heaters. The fixing temperature controller is operatively connected to the drive circuit to control the drive circuit to selectively energize at least one of the plurality of heaters according to an image area on the recording medium where the toner image is formed on the recording medium. The image area corresponds to the plurality of axial heating spans on the fixing rotary body. The fixing temperature controller controls the energized, at least one of the plurality of heaters based on the detected temperature of the pressing rotary body so as to heat the fixing rotary body to a target temperature.

At least one embodiment provides a novel image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
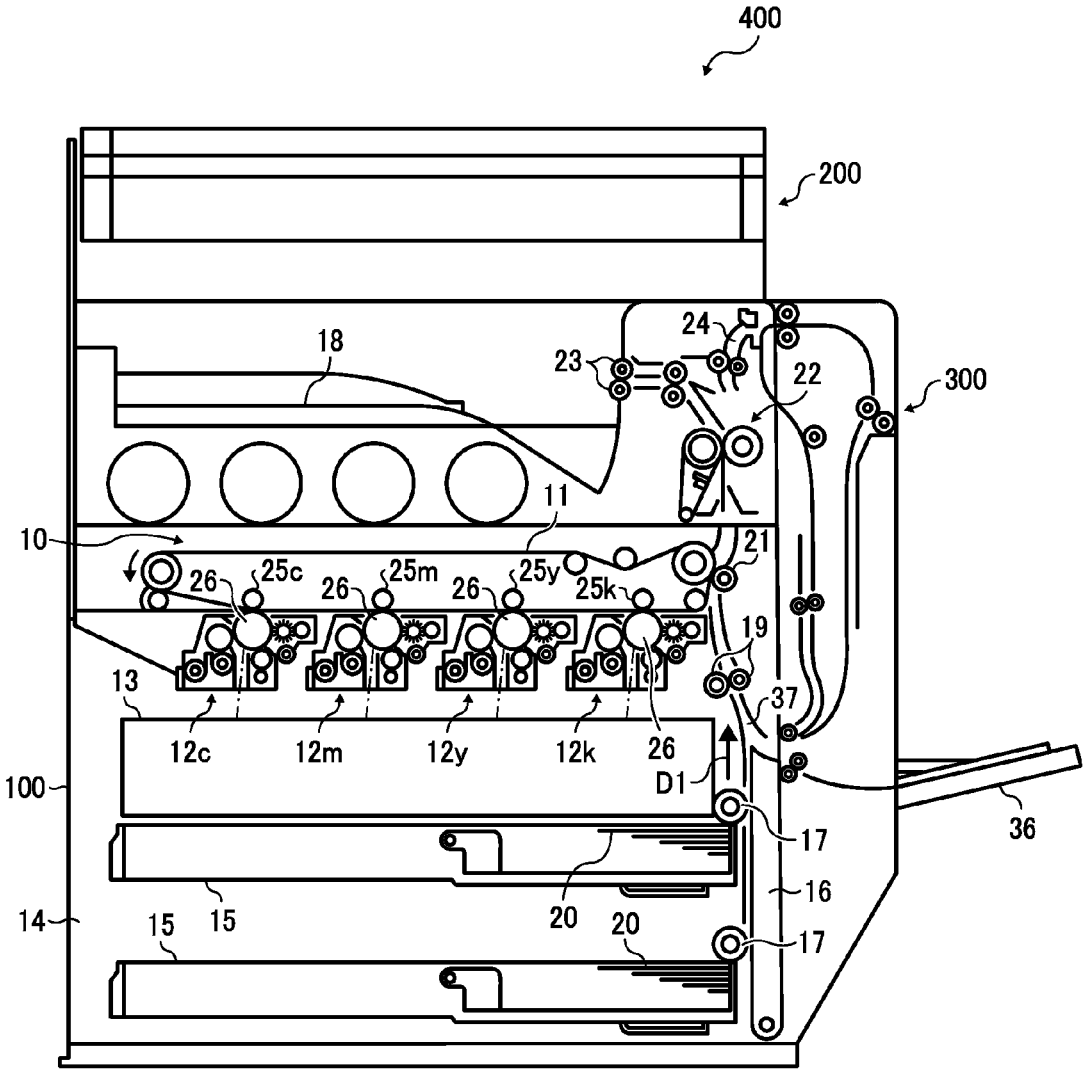
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 400 according to an example embodiment is explained.

FIG. 1 is a schematic vertical sectional view of the image forming apparatus 400. The image forming apparatus 400 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 400 is a tandem color copier that forms color and monochrome toner images on recording media by electrophotography.

The image forming apparatus 400 includes a body 100, an image reader 200 placed on the body 100, and a duplex unit 300 attached to a right side of the body 100. The body 100 includes an intermediate transfer device 10 that incorporates an endless, intermediate transfer belt 11 stretched taut across a plurality of rollers. The intermediate transfer belt 11 extending substantially horizontally is rotatable counterclockwise in FIG. 1.

Below the intermediate transfer device 10 are four image forming devices 12*c*, 12*m*, 12*y*, and 12*k* that form cyan, magenta, yellow, and black toner images, respectively. The image forming devices 12*c*, 12*m*, 12*y*, and 12*k* are aligned in tandem along a lower face of the intermediate transfer belt 11 that extends substantially horizontally. Each of the image forming devices 12*c*, 12*m*, 12*y*, and 12*k* includes a drum-shaped photoconductor 26 serving as an image carrier rotatable clockwise in FIG. 1 and surrounded by a charger, a development device, a primary transfer device, and a cleaner. Primary transfer devices 25*c*, 25*m*, 25*y*, and 25*k* are disposed opposite the photoconductors 26, respectively, via the intermediate transfer belt 11. Below the image forming devices 12*c*, 12*m*, 12*y*, and 12*k* is an exposure device 13.

Below the exposure device 13 is a sheet feeder 14. The sheet feeder 14 includes two paper trays 15 aligned vertically and containing a plurality of recording media 20. Each paper tray 15 mounts a feed roller 17 on an upper right side thereof. The feed roller 17 picks up and feeds an uppermost recording medium 20 from the plurality of recording media 20 loaded on the paper tray 15 into a main path 16.

The main path 16 extends upward from a right bottom to a right top of the body 100 and communicates with an internal output tray 18 situated atop the body 100 and interposed between the body 100 and the image reader 200. The main path 16 is substantially vertically aligned with a registration roller pair 19, a secondary transfer device 21 disposed opposite the intermediate transfer belt 11, a fixing device 22, and an output device 23 constructed of an output roller pair. Upstream from the registration roller pair 19 in a recording medium conveyance direction D1 is a bypass 37 in communication with the duplex unit 300 and the main path 16. The bypass 37 receives the recording medium 20 from the duplex unit 300 or from a bypass tray 36 attached to the duplex unit 300 and conveys the recording medium 20 to the main path 16. Downstream from the fixing device 22 in the recording medium conveyance direction D1 is a duplex path 24 branching from the main path 16 and communicating with the duplex unit 300.

A description is provided of a copying operation to form a color toner image on a recording medium 20 performed by the image forming apparatus 400 having the structure described above.

As the image forming apparatus 400 receives a print job, the image reader 200 reads an image on an original into image data. The exposure device 13 writes an electrostatic latent image on the photoconductor 26 of the respective image forming devices 12*c*, 12*m*, 12*y*, and 12*k* according to the image data created by the image reader 200. The development devices of the image forming devices 12*c*, 12*m*, 12*y*, and 12*k* visualize the electrostatic latent images as cyan, magenta, yellow, and black toner images, respectively. The primary transfer devices 25*c*, 25*m*, 25*y*, and 25*k* primarily transfer the cyan, magenta, yellow, and black toner images formed on the photoconductors 26 onto the intermediate transfer belt 11 successively such that the cyan, magenta, yellow, and black toner images are superimposed on a same position on the intermediate transfer belt 11, thus forming a color toner image thereon.

On the other hand, one of the two feed rollers 17 is selectively rotated to pick up and feed a recording medium 20 from the corresponding paper tray 15 to the main path 16. Alternatively, a recording medium 20 placed on the bypass tray 36 is conveyed to the main path 16 through the bypass 37. The registration roller pair 19 situated in the main path 16 conveys the recording medium 20 to a secondary transfer nip formed between the secondary transfer device 21 and the intermediate transfer belt 11 at a proper time when the color toner image formed on the intermediate transfer belt 11 reaches the secondary transfer nip. As the recording medium 20 is conveyed through the secondary transfer nip, the secondary transfer device 21 secondarily transfers the color toner image formed on the intermediate transfer belt 11 onto the recording medium 20. After the secondary transfer, the fixing device 22 fixes the color toner image on the recording medium 20. Thereafter, the output device 23 discharges the recording medium 20 bearing the fixed color toner image onto the internal output tray 18 where the recording medium 20 is stacked.

If the image forming apparatus 400 receives a duplex print job, the recording medium 20 bearing the fixed color toner image on a front side thereof is conveyed to the duplex unit 300 through the duplex path 24. The duplex unit 300 reverses and conveys the recording medium 20 to the main path 16 through the bypass 37. As the recording medium 20 is conveyed through the secondary transfer nip, another color toner image formed on the intermediate transfer belt 11 is secondarily transferred onto a back side of the recording medium 20. Thereafter, the fixing device 22 fixes the color toner image on the recording medium 20 and the output device 23 discharges the recording medium 20 bearing the fixed color toner image on both sides thereof onto the internal output tray 18.

Figure 2:
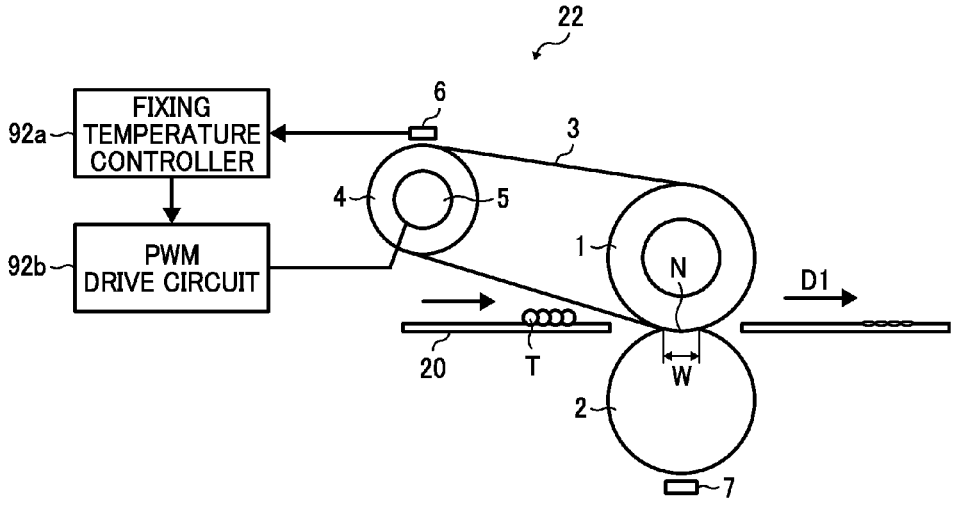
FIG. 2 is a vertical sectional view of a fixing device incorporated in the image forming apparatus shown in FIG. 1.

With reference to FIG. 2, a description is provided of a configuration of the fixing device 22 incorporated in the image forming apparatus 400 described above.

FIG. 2 is a schematic vertical sectional view of the fixing device 22. As shown in FIG. 2, the fixing device 22 (e.g., a fuser) includes a fixing roller 1; a heating roller 4 accommodating a halogen heater set 5 serving as a heater; an endless fixing belt 3, serving as a fixing rotary body, looped over the fixing roller 1 and the heating roller 4; and a pressing roller 2, serving as a pressing rotary body, pressed against the fixing roller 1 via the fixing belt 3.

For example, a shaft of the fixing roller 1 is stationary and a shaft of the pressing roller 2 is movable so that the pressing roller 2 is separably biased and pressed against the fixing roller 1 via the fixing belt 3 by a spring, thus forming a fixing nip N having a fixing nip width W between the pressing roller 2 and the fixing belt 3. Alternatively, the shaft of the fixing roller 1 may be movable and the shaft of the pressing roller 2 may be stationary so that the fixing roller 1 is separably biased and pressed against the pressing roller 2 via the fixing belt 3 by a spring.

As a recording medium 20 bearing a toner image T is conveyed through the fixing nip N, the fixing belt 3 heated by the halogen heater set 5 through the heating roller 4 comes into contact with and heats the unfixed toner image T on the front side of the recording medium 20; the pressing roller 2 comes into contact with the back side of the recording medium 20 bearing no unfixed toner image T and exerts pressure to the recording medium 20, fixing the toner image T on the recording medium 20 under heat and pressure.

The pressing roller 2 is a sponge roller having a decreased heat capacity and accommodating no heater. Alternatively, the pressing roller 2 may accommodate a heater. A temperature sensor 7 serving as a temperature detector is disposed opposite an outer circumferential surface of the pressing roller 2 to detect the temperature of the pressing roller 2.

Figure 3:
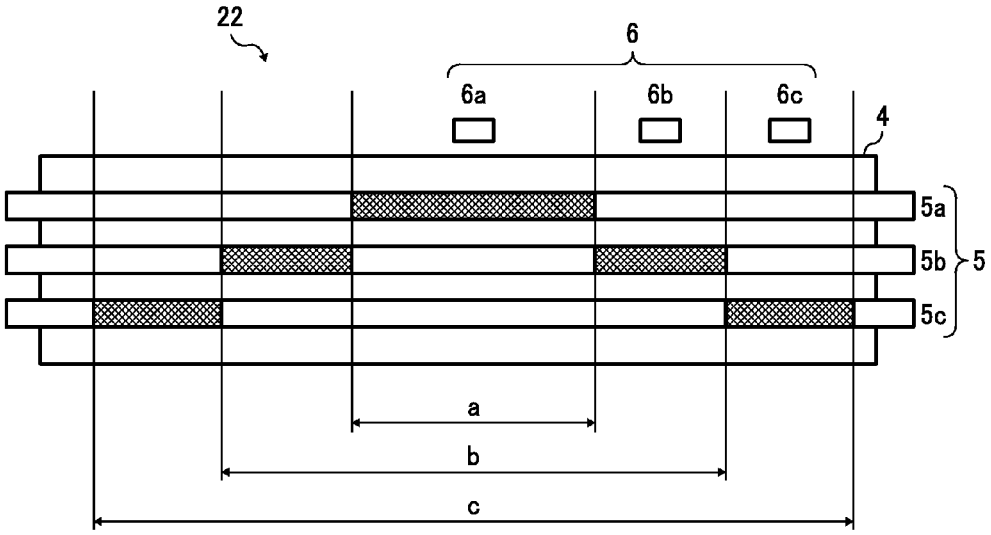
FIG. 3 is a partial sectional side view of the fixing device shown in FIG. 2 illustrating a halogen heater set and a non-contact temperature sensor set incorporated therein.

With reference to FIG. 3, a detailed description is now given of a configuration of the halogen heater set 5.

As shown in FIG. 2, the halogen heater set 5 serving as a heater is situated inside the hollow heating roller 4 to heat the heating roller 4 which in turn heats the fixing belt 3. The halogen heater set 5 is configured to selectively heat a plurality of axial heating spans on the heating roller 4 according to various sizes of recording media 20 as shown in FIG. 3. FIG. 3 is a partial sectional side view of the fixing device 22. As shown in FIG. 3, the halogen heater set 5 includes three halogen heaters, that is, a first halogen heater 5*a*, a second halogen heater 5*b*, and a third halogen heater 5*c* that correspond to the plurality of axial heating spans on the heating roller 4. The center, first halogen heater 5*a* heats a center, first axial heating span a on the heating roller 4 in a longitudinal direction thereof. The second halogen heater 5*b*, together with the first halogen heater 5*a*, heats a second axial heating span b on the heating roller 4 in the longitudinal direction thereof, that is greater than the first axial heating span a. The third halogen heater 5*c*, together with the first halogen heater 5*a* and the second halogen heater 5*b*, heats a third axial heating span c on the heating roller 4 in the longitudinal direction thereof, that is greater than the second axial heating span b. Thus, the halogen heater set 5 is divided into the three halogen heaters in the longitudinal direction of the heating roller 4.

A description is provided of a temperature control method of the fixing device 22 for controlling the temperature of the fixing belt 3.

As shown in FIG. 2, a non-contact temperature sensor set 6 is disposed opposite and in proximity to an outer circumferential surface of the fixing belt 3 to detect the temperature of the fixing belt 3. As shown in FIG. 3, the non-contact temperature sensor set 6 includes three non-contact temperature sensors, that is, a first temperature sensor 6*a*, a second temperature sensor 6*b*, and a third temperature sensor 6*c* disposed opposite the first axial heating span a, the second axial heating span b, and the third axial heating span c on the heating roller 4 heated by the first halogen heater 5*a*, the second halogen heater 5*b*, and the third halogen heater 5*c*, respectively.

According to this example embodiment, the fixing device 22 includes the first halogen heater 5*a*, the second halogen heater 5*b*, and the third halogen heater 5*c* corresponding to various sizes of recording media 20 and the first temperature sensor 6*a*, the second temperature sensor 6*b*, and the third temperature sensor 6*c* disposed opposite the first halogen heater 5*a*, the second halogen heater 5*b*, and the third halogen heater 5*c* to detect the temperature of the first axial heating span a, the second axial heating span b, and the third axial heating span c on the fixing belt 3, respectively.

As shown in FIG. 2, a pulse width modulation (PWM) drive circuit 92*b* is operatively connected to the halogen heater set 5 to supply power to the halogen heater set 5. A fixing temperature controller 92*a* is operatively connected to the non-contact temperature sensor set 6 and the PWM drive circuit 92*b* to control power supplied to the halogen heater set 5 by the PWM drive circuit 92*b* by DUTY, that is, energization time per unit hour, based on a difference between a specified target temperature of the fixing belt 3 and the temperature of the fixing belt 3 detected by the non-contact temperature sensor set 6.

The fixing temperature controller 92*a* controls the PWM drive circuit 92*b* to selectively energize the first halogen heater 5*a*, the second halogen heater 5*b*, and the third halogen heater 5*c* based on the size of the recording medium 20 and image information, that is, an image area where the toner image T adheres to the recording medium 20. Accordingly, the halogen heater set 5 heats the heating roller 4 which in turn heats the fixing belt 3 in the axial heating span corresponding to the image area on the recording medium 20, thus heating the image area on the recording medium 20 to the target fixing temperature. With the configuration described above, the fixing temperature controller 92*a* controls the PWM drive circuit 92*b* to adjust an amount of power supplied to the halogen heater set 5 such that the halogen heater set 5 conducts a desired amount of heat to the recording medium 20 and the toner image T formed thereon as the recording medium 20 is conveyed through the fixing nip N.

The temperature control method described above uses the halogen heater set 5 as a heater. Alternatively, other heaters, such as a resistance heat generator, a ceramic heater, and an induction heating coil, that selectively heat the various axial heating spans on the fixing belt 3 may be used as a heater.

Figure 4:
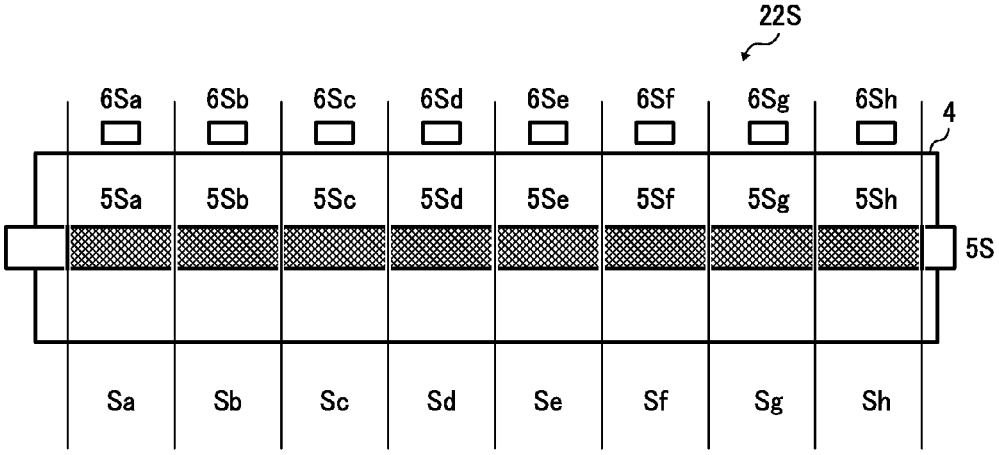
FIG. 4 is a partial sectional side view of a fixing device incorporating a resistance heat generator set.

It is preferable that the axial span of the fixing belt 3 is divided into axial heating spans as many as possible to save energy as shown in FIG. 4. FIG. 4 is a partial sectional side view of a fixing device 22S incorporating a resistance heat generator set 5S. As shown in FIG. 4, the resistance heat generator set 5S includes eight resistance heat generators 5Sa, 5Sb, 5Sc, 5Sd, 5Se, 5Sf, 5Sg, and 5Sh aligned in the longitudinal direction of the heating roller 4. Eight non-contact temperature sensors 6Sa, 6Sb, 6Sc, 6Sd, 6Se, 6Sf, 6Sg, and 6Sh are disposed opposite the eight resistance heat generators 5Sa, 5Sb, 5Sc, 5Sd, 5Se, 5Sf, 5Sg, and 5Sh, respectively, to detect the temperature of the fixing belt 3 in eight axial heating spans Sa, Sb, Sc, Sd, Se, Sf, Sg, and Sh, respectively. The fixing temperature controller 92*a* controls the PWM drive circuit 92*b* to selectively energize the resistance heat generators 5Sa, 5Sb, 5Sc, 5Sd, 5Se, 5Sf, 5Sg, and 5Sh to heat the fixing belt 3 via the heating roller 4 in one or more axial heating spans corresponding to the image area on the recording medium 20 precisely based on the size of the recording medium 20 and image information, that is, the image area on the recording medium 20, thus heating the image area on the recording medium 20 bearing the fixed toner image T to the target fixing temperature. Similar to the fixing device 22 depicted in FIG. 2, the fixing device 22S employs the temperature control method described above to heat the desired axial heating span on the fixing belt 3 to the target fixing temperature.

For example, the fixing temperature controller 92*a* may acquire the size of the recording medium 20 and the image area on the recording medium 20 from image data created by the image reader 200 or from image data sent from an external device, such as a client computer.

A nip conveyance time for which the recording medium 20 is conveyed through the fixing nip N (hereinafter referred to as the nip conveyance time) defines a time obtained by dividing the fixing nip width W by a conveyance speed of the recording medium 20. A particular point on the toner image T on the recording medium 20 is heated for the nip conveyance time as the recording medium 20 is conveyed through the fixing nip N and fixed on the recording medium 20.

Figure 5:
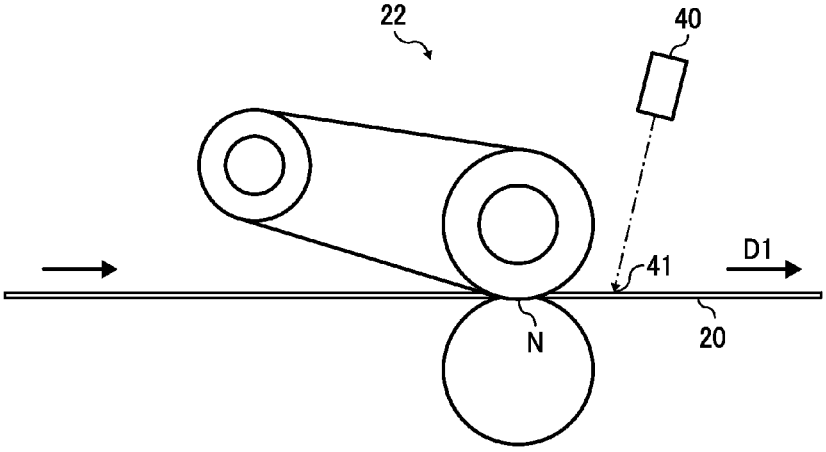
FIG. 5 is a schematic vertical sectional view of the fixing device shown in FIG. 2 illustrating a non-contact temperature sensor.
Figure 6:
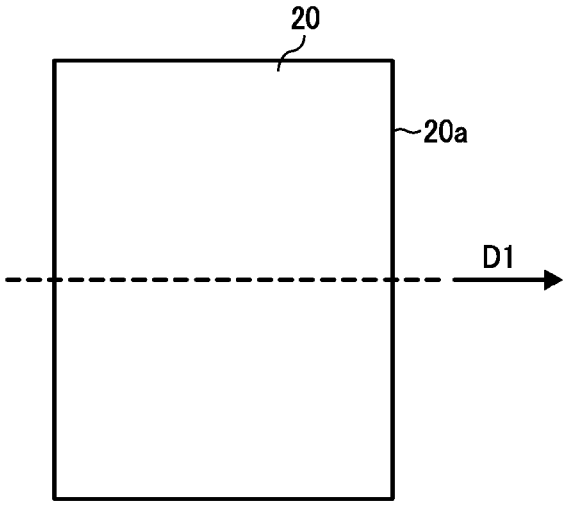
FIG. 6 is a plan view of a recording medium conveyed through the fixing device shown in FIG. 2.

With reference to FIGS. 5 and 6, a description is provided of a temperature measurement method for measuring the temperature of the recording medium 20 bearing the fixed toner image T that is discharged from the fixing nip N by using a temperature sensor.

FIG. 5 is a schematic vertical sectional view of the fixing device 22 illustrating a non-contact temperature sensor 40. As shown in FIG. 5, the temperature sensor 40 is situated downstream from and in proximity to an exit of the fixing nip N in the recording medium conveyance direction D1 to detect the temperature of the recording medium 20 discharged from the fixing nip N at a detection position 41 immediately after the recording medium 20 is discharged from the fixing nip N. The temperature sensor 40 may be a temperature sensor FT-H20 available from Keyence Corporation.

FIG. 6 is a plan view of the recording medium 20 seen from the fixing belt 3. FIG. 6 illustrates a temperature detection position on the recording medium 20 where the temperature sensor 40 detects the temperature of the recording medium 20. According to this example embodiment, an A4 size sheet is used as a recording medium 20. A leading edge 20*a* of the recording medium 20 conveyed in the recording medium conveyance direction D1 defines a long edge of the recording medium 20. As the recording medium 20 is conveyed through the fixing device 22 in the recording medium conveyance direction D1, the temperature sensor 40 depicted in FIG. 5 detects the temperature of the recording medium 20 at the temperature detection position indicated by the dotted line that extends in the recording medium conveyance direction D1 through a substantially center of the recording medium 20 in an axial direction of the fixing belt 3 perpendicular to the recording medium conveyance direction D1.

Figure 7:
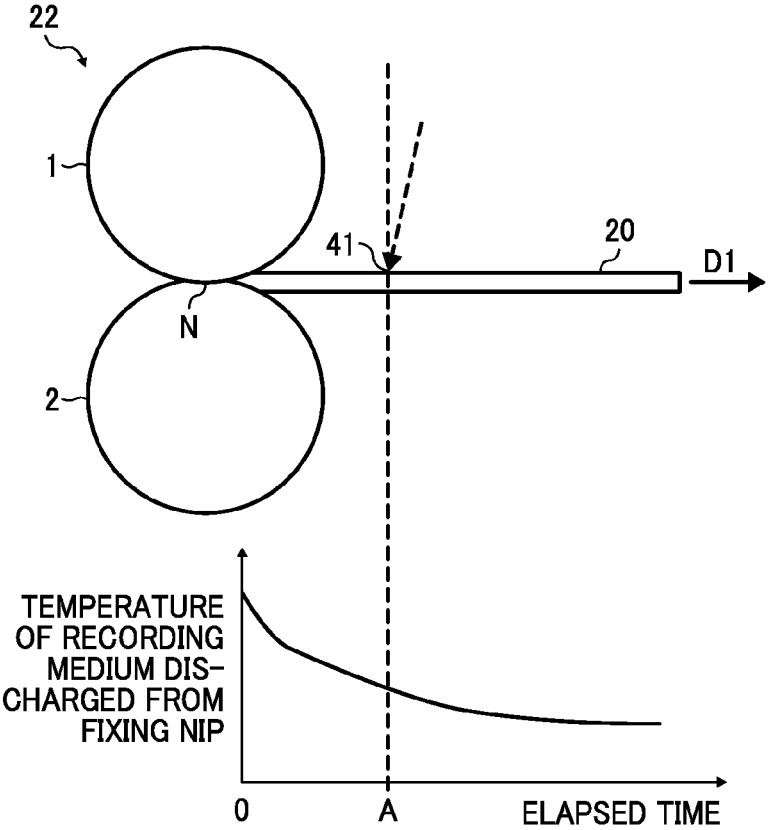
FIG. 7 is a diagram illustrating the recording medium discharged from a fixing nip of the fixing device shown in FIG. 2 and a graph showing the temperature of the recording medium changing over time.

With reference to FIG. 7, a description is provided of change in temperature of the recording medium 20 discharged from the fixing nip N as it is conveyed in the recording medium conveyance direction D1.

FIG. 7 is a diagram illustrating the recording medium 20 discharged from the fixing nip N formed between the fixing belt 3 and the pressing roller 2 and a graph showing the temperature of the recording medium 20 changing over time. For example, the graph shows a relation between an elapsed time elapsed after the recording medium 20 is discharged from the fixing nip N and the temperature of the recording medium 20 detected at the detection position 41. The recording medium 20 is heated as it is conveyed through the fixing nip N and cooled by air after it is discharged from the fixing nip N. As time elapses, the temperature of the recording medium 20 decreases gradually as shown in FIG. 7. In order to detect the temperature of the recording medium 20 at which the toner image T is fixed on the recording medium 20 precisely, it is preferable that the detection position 41 is situated as close as possible to the fixing nip N. However, in view of limited space, the temperature sensor 40 is spaced apart from the exit of the fixing nip N by a distance in a range of from about 10 mm to about 30 mm or situated at a position A where the temperature sensor 40 detects the temperature of the recording medium 20 when a time in a range of from about 50 ms to about 300 ms elapses after the recording medium 20 is discharged from the fixing nip N.

Figure 8:
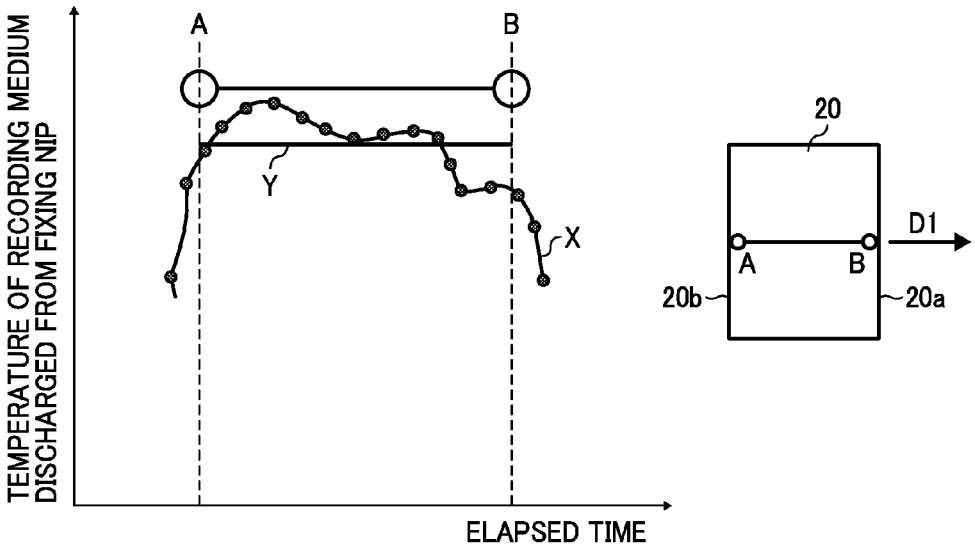
FIG. 8 is a graph showing a relation between the elapsed time elapsed after the recording medium is discharged from the fixing nip of the fixing device shown in FIG. 2 and the temperature of the recording medium.

With reference to FIG. 8, a description is provided of definition of the temperature of the recording medium 20 detected by the temperature sensor 40.

FIG. 8 is a graph showing a relation between the elapsed time elapsed after the recording medium 20 is discharged from the fixing nip N and the temperature of the recording medium 20, which is obtained by a measurement. The temperature sensor 40 detects the temperature of the recording medium 20 discharged from the fixing nip N using a sampling period of 10 ms. A temperature wave X is obtained by the measurement. Temperatures of the recording medium 20 detected by the temperature sensor 40 are taken from the temperature wave X. Since the temperature sensor 40 has a spot diameter, temperatures in a region between positions B and A defined by the leading edge 20*a* and a trailing edge 20*b* of the recording medium 20 in the recording medium conveyance direction D1, respectively, where all spots of the temperature sensor 40 are on the recording medium 20, are taken from the temperature wave X. An average Y obtained from the temperatures taken from the temperature wave X defines the temperature of the recording medium 20 discharged from the fixing nip N.

A description is provided of a relation between the temperature of the recording medium 20 discharged from the fixing nip N detected by the temperature measurement method described above and fixing property, that is, fixing strength with which the toner image T is fixed on the recording medium 20 and gloss level of the toner image T fixed on the recording medium 20.

First, with reference to FIGS. 9A to 12, a description is given of a relation between the temperature of the recording medium 20 discharged from the fixing nip N and the fixing strength.

Figure 9A:
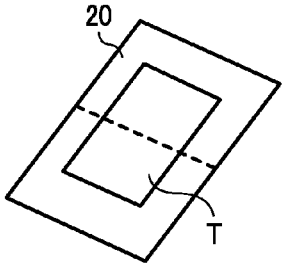
FIG. 9A is a perspective view of the recording medium bearing a fixed toner image before being folded.
Figure 9B:
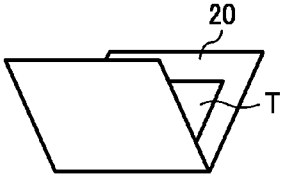
FIG. 9B is a perspective view of the recording medium shown in FIG. 9A folded gently such that the toner image fixed on the recording medium is disposed opposite each other.
Figure 9C:
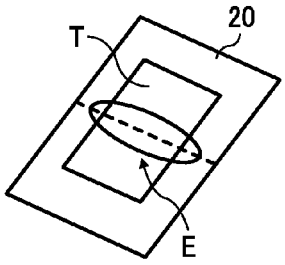
FIG. 9C is a perspective view of the unfolded recording medium shown in FIG. 9B.

The fixing strength is evaluated by observing how much toner peels off the recording medium 20 as the recording medium 20 is folded and graded as below. FIGS. 9A to 9C illustrate diagrams showing the recording medium 20 folded and unfolded for evaluation.

Figure 10:
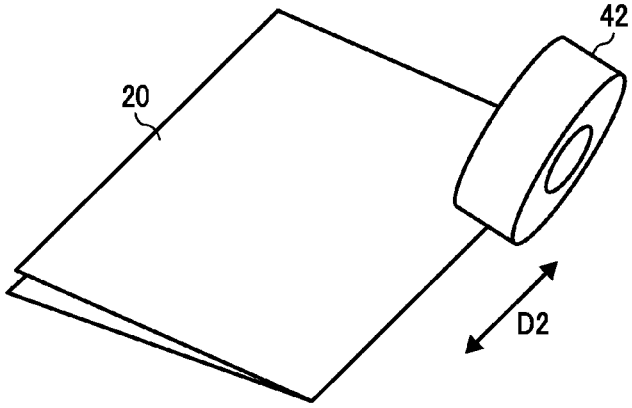
FIG. 10 is a perspective view of the folded recording medium shown in FIG. 9B illustrating a weight rolling thereon.

FIG. 9A is a perspective view of the recording medium 20 bearing a fixed toner image T before being folded. FIG. 9B is a perspective view of the recording medium 20 folded gently along the dotted line in FIG. 9A such that the toner image T fixed on the recording medium 20 is disposed opposite each other. FIG. 9C is a perspective view of the unfolded recording medium 20. FIG. 10 is a perspective view of the folded recording medium 20. As shown in FIG. 10, a weight 42 placed on the folded recording medium 20 rolls on the recording medium 20 in a direction D2 to create a fold thereon. The weight 42 is a cylinder having a width of 50 mm and a weight of 1 kg. The weight 42 rolls on a folded part of the recording medium 20 back and forth once, creating a fold on the recording medium 20. After the recording medium 20 is unfolded as shown in FIG. 9C, a waste gently slides over the toner image T in an evaluation region E in the folded part of the recording medium 20, removing toner peeled off the recording medium 20 therefrom.

Figure 11:
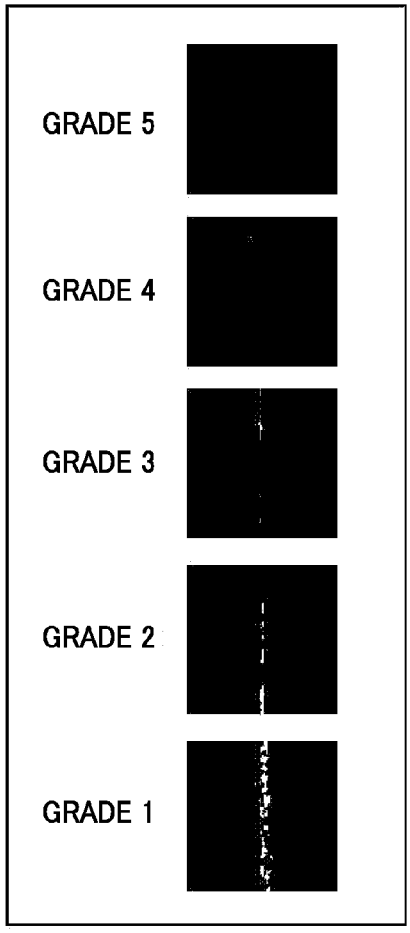
FIG. 11 is a diagram illustrating toner image patterns of the toner image on the recording medium shown in FIG. 9C graded 1 to 5.

How the toner of the toner image T is peeled off the recording medium 20 in the evaluation region E depicted in FIG. 9C is examined and compared with sample patterns for grading the fixing strength, thus being evaluated in five grades shown in FIG. 11 to determine the fixing strength.

FIG. 11 is a diagram illustrating the sample patterns of the toner image T in the evaluation region E graded 1 to 5. The toner image pattern of grade 1 illustrates the toner image T where toner is peeled off throughout the evaluation region E. The toner image pattern of grade 2 illustrates the toner image T where toner is peeled off in an amount smaller than that of the toner image pattern of grade 1. The toner image pattern of grade 3 illustrates the toner image T where toner is peeled off in an amount smaller than that of the toner image pattern of grade 2. The toner image pattern of grade 4 illustrates the toner image T where toner is barely peeled off. The toner image pattern of grade 5 illustrates the toner image T where no toner is peeled off.

Figure 12:
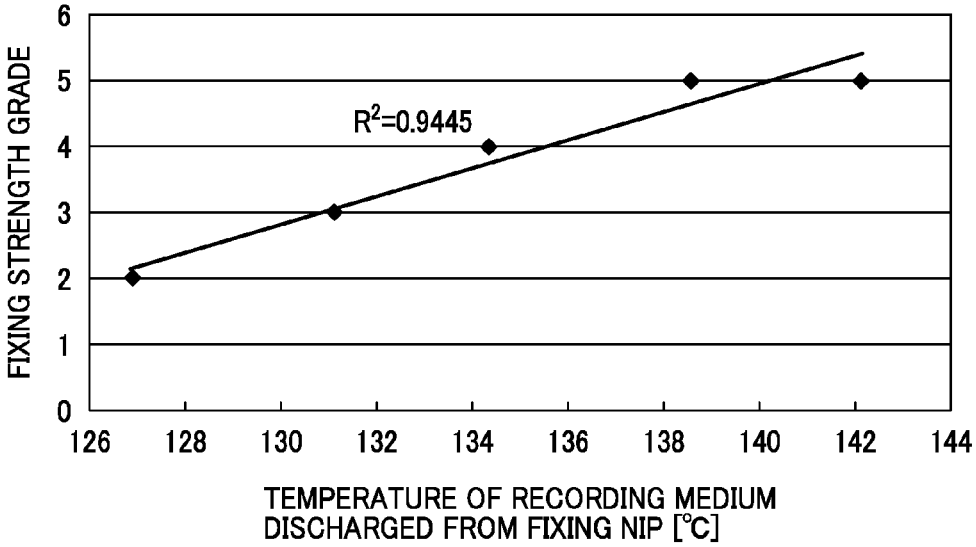
FIG. 12 is a graph showing a relation between the temperature of the recording medium discharged from the fixing nip of the fixing device shown in FIG. 2 and the fixing strength graded 1 to 5 shown in FIG. 11.

FIG. 12 is a graph showing a relation between the temperature of the recording medium 20 discharged from the fixing nip N and the fixing strength graded 1 to 5 shown in FIG. 11. As shown in FIG. 12, the temperature of the recording medium 20 discharged from the fixing nip N shows a substantially strong correlation with the fixing strength grade. As the temperature of the recording medium 20 discharged from the fixing nip N increases, the fixing strength also increases. For example, the graph depicted in FIG. 12 shows the correlation under an ambient temperature of 23 degrees centigrade, a humidity of 50 percent, a temperature of the fixing belt 3 of 180 degrees centigrade, and a paper weight of the recording medium 20 of 90 g/m$^2$. $R^2$ defining a correlation function close to 1 indicates that the temperature of the recording medium 20 discharged from the fixing nip N has a strong correlation with the fixing strength grade.

Figure 13:
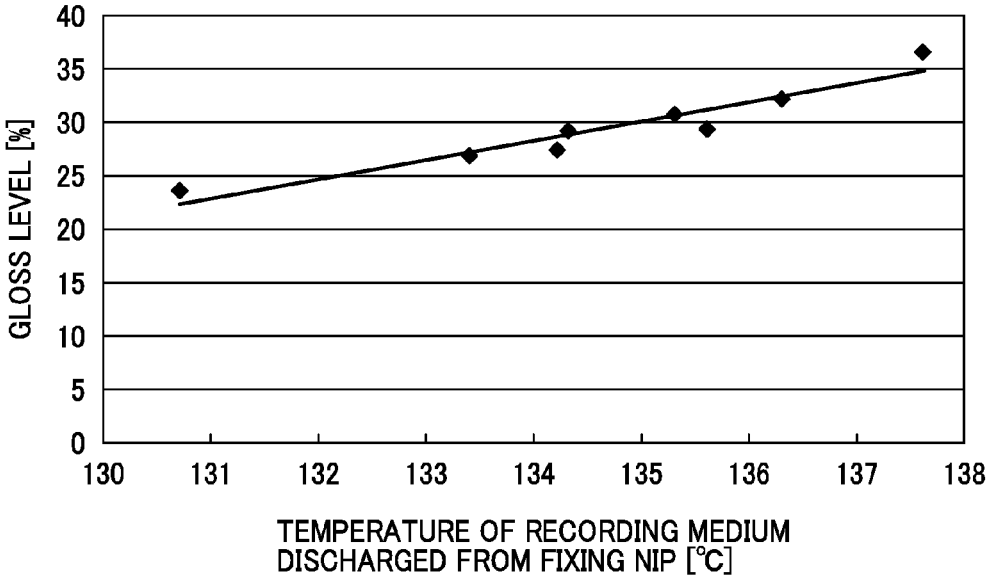
FIG. 13 is a graph showing a relation between the temperature of the recording medium discharged from the fixing nip of the fixing device shown in FIG. 2 and the gloss level of the toner image fixed on the recording medium.

Next, with reference to FIG. 13, a description is given of a relation between the temperature of the recording medium 20 discharged from the fixing nip N and the gloss level of the toner image T fixed on the recording medium 20 that is one of parameters to evaluate quality of the toner image T fixed on the recording medium 20. The gloss level is a parameter representing gloss of the toner image T fixed on the recording medium 20 that is measured with a gloss meter.

FIG. 13 is a graph showing a relation between the temperature of the recording medium 20 discharged from the fixing nip N and the gloss level of the toner image T fixed on the recording medium 20, which is obtained by the measurement described above with reference to FIGS. 5 to 8. As shown in FIG. 13, the temperature of the recording medium 20 discharged from the fixing nip N shows a strong correlation with the gloss level. The measurement shown in FIG. 13 is performed under the conditions of the measurement shown in FIG. 12. As shown in FIG. 13, as the temperature of the recording medium 20 discharged from the fixing nip N increases, the gloss level also increases. The gradient of an approximate line shown in FIG. 13 provides a gloss level of 15 percent per the temperature of the recording medium 20 discharged from the fixing nip N of 10 degrees centigrade.

In order to control the fixing property defining fixing quality, such as the fixing strength and the gloss level, to a desired value, it is required to control the temperature of the recording medium 20 discharged from the fixing nip N to a target temperature. Further, it is preferable to maintain the temperature of the recording medium 20 discharged from the fixing nip N, the fixing strength, and the gloss level at desired given values in view of energy saving. It is because the recording medium 20 having a relatively high temperature when it is discharged from the fixing nip N has consumed an increased amount of heat from the halogen heater set 5 compared to when the recording medium 20 has a relatively low temperature.

A description is provided of change in the temperature of the recording medium 20 discharged from the fixing nip N caused by change in the temperature of the pressing roller 2 incorporated in a conventional fixing device. A part of heat may be conducted to the recording medium 20 from the pressing roller 2 and therefore the pressing roller 2 may change the temperature of the recording medium 20 discharged from the fixing nip N substantially. However, conventionally, heat conduction from the pressing roller 2 to the fixing belt 3 may not be controlled, varying the temperature of the recording medium 20 discharged from the fixing nip N.

Figure 14:
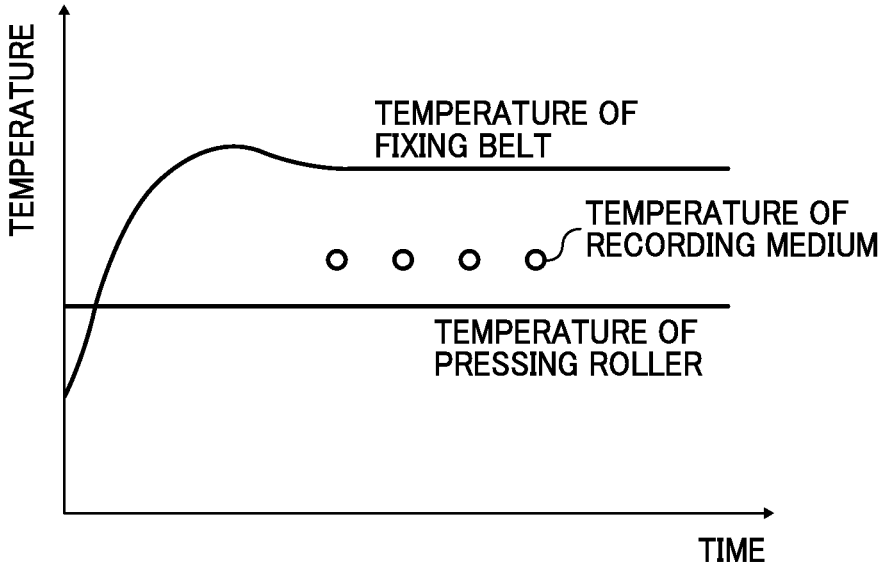
FIG. 14 is a graph showing a relation between time and the temperature of a fixing belt and a pressing roller incorporated in the fixing device shown in FIG. 2 and a recording medium conveyed therein when a heater is disposed opposite the pressing roller.

With reference to FIG. 14, a description is provided of the temperature of the recording medium 20 discharged from the fixing nip N changing over time if a heater is disposed opposite the pressing roller 2.

FIG. 14 is a graph showing a relation between time and the temperature of the fixing belt 3, the pressing roller 2, and the recording medium 20. If the heater is disposed opposite the pressing roller 2, the temperature of the pressing roller 2 is controlled to be constant regardless of print conditions. As the temperature of the pressing roller 2 is constant, the temperature of the recording medium 20 discharged from the fixing nip N is also constant as shown in FIG. 14, thus maintaining the fixing property.

Figure 15:
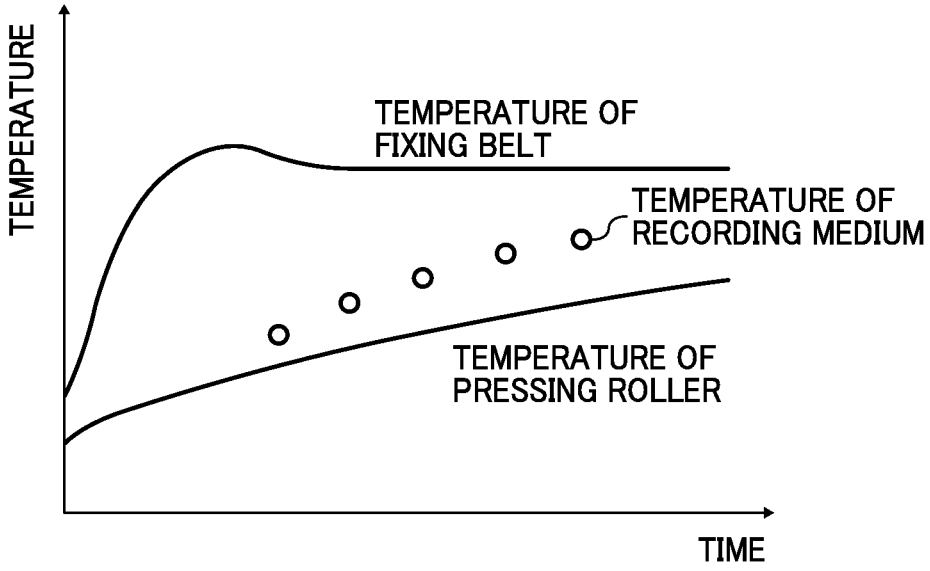
FIG. 15 is a graph showing a relation between time and the temperature of the fixing belt, the pressing roller, and the recording medium when no heater is disposed opposite the pressing roller.

With reference to FIG. 15, a description is provided of the temperature of the recording medium 20 discharged from the fixing nip N that changes over time if no heater is disposed opposite the pressing roller 2.

FIG. 15 is a graph showing a relation between time and the temperature of the fixing belt 3, the pressing roller 2, and the recording medium 20. In order to heat the front side of the recording medium 20 that bears the unfixed toner image T and prevent the pressing roller 2 in contact with the back side of the recording medium 20 that does not bear the unfixed toner image T from storing heat in view of energy saving, no heater is disposed opposite the pressing roller 2 or, even if a heater is disposed opposite the pressing roller 2, the heater is turned off during printing.

In this case, the pressing roller 2 may have a decreased thermal capacity and therefore may be susceptible to temperature change as an operating condition changes. For example, when the image forming apparatus 400 enters a sleep mode or a plurality of recording media 20 is conveyed through the fixing device 22 continuously, the temperature of the pressing roller 2 may change readily over time. Accordingly, the temperature of the recording medium 20 may also change readily, degrading fixing property or wasting energy.

One method to maintain the temperature of the recording medium 20 discharged from the fixing nip N at a target temperature regardless of change in the temperature of the pressing roller 2 is to locate the temperature sensor 40 as shown in FIG. 5 and perform a feedback control based on the temperature of the recording medium 20 discharged from the fixing nip N directly detected by the temperature sensor 40. However, installation of the relatively expensive temperature sensor 40 may increase manufacturing costs of the image forming apparatus 400.

To address this circumstance, the fixing device 22 employs a fixing device temperature control method to maintain the temperature of the image area on the recording medium 20 discharged from the fixing nip N (hereinafter referred to as the temperature of the recording medium 20 discharged from the fixing nip N) at a target temperature as described below. The fixing device temperature control method maintains the temperature of the recording medium 20 discharged from the fixing nip N at a substantially constant temperature, not by feedback control to feed back the temperature of the recording medium 20 discharged from the fixing nip N that is detected by the temperature sensor 40 but by feedback control to feed back a target temperature of the fixing belt 3 by using correction calculation based on the temperature of the pressing roller 2, thus avoiding increased manufacturing costs caused by installation of the temperature sensor 40 for detecting the temperature of the recording medium 20 discharged from the fixing nip N.

First, a description is given of simulation performed for the fixing device temperature control method.

Figure 16:
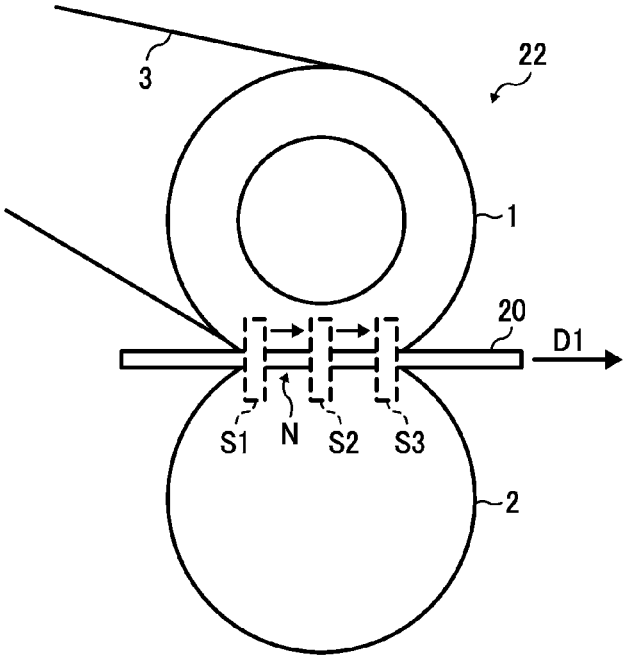
FIG. 16 is a schematic vertical sectional view of the fixing device shown in FIG. 2 for explaining simulation of heat conduction.

FIG. 16 is a schematic vertical sectional view of the fixing device 22 illustrating change in simulation positions and explaining calculation of the temperature of the recording medium 20 discharged from the fixing nip N.

As the recording medium 20 is conveyed through the fixing device 22, the recording medium 20 is heated by heat conduction from the fixing belt 3 and the pressing roller 2. Accordingly, heat conduction is simulated. As shown in FIG. 16, heat conduction from the fixing belt 3 to the recording medium 20 as the recording medium 20 is conveyed through the fixing nip N is simulated.

FIG. 16 illustrates three simulation positions in the fixing nip N indicated by the dotted line: a first simulation position S1 situated at an entry to the fixing nip N; a second simulation position S2 situated at a middle of the fixing nip N; and a third simulation position S3 situated at the exit of the fixing nip N. The temperature distribution of the fixing belt 3, the recording medium 20, and the pressing roller 2 at the first simulation position S1 before the toner image T is fixed on the recording medium 20 is used as a default. Based on the default, calculation is performed to obtain an amount of heat conduction at the second simulation position S2 while the toner image T is fixed on the recording medium 20 and at the third simulation position S3 after the toner image T is fixed on the recording medium 20. The amount of heat conduction among the fixing belt 3, the recording medium 20, and the pressing roller 2 at the second simulation position S2 is calculated based on a heat conduction equation. The amount of heat conduction at the fixing nip N is calculated by a heat conduction equation (1) below as a basic formula.

$$\rho_c \frac{\partial \theta}{\partial t} = \frac{\partial}{\partial x}\left(\lambda \frac{\partial \theta}{\partial x}\right) + \frac{\partial}{\partial y}\left(\lambda \frac{\partial \theta}{\partial y}\right) \quad (1)$$

In the heat conduction equation (1), θ represents a temperature, ρ represents a density of the fixing belt 3 in contact with the toner image T on the recording medium 20, c represents a specific heat of the fixing belt 3, and λ represents a thermal conductivity of the fixing belt 3. Since the heat conduction equation (1) is nonlinear, a solution is not obtained readily.

To address this circumstance, according to this example embodiment, a numerical solution is obtained by approximation using calculus of finite differences, thus simulating the temperature of the recording medium 20 discharged from the fixing nip N. A detailed description of the solution is omitted.

First, a description is given of a fixing device temperature control method for controlling the temperature of the recording medium 20 discharged from the fixing nip N based on the temperature of the pressing roller 2 detected by the temperature sensor 7.

Figure 17:
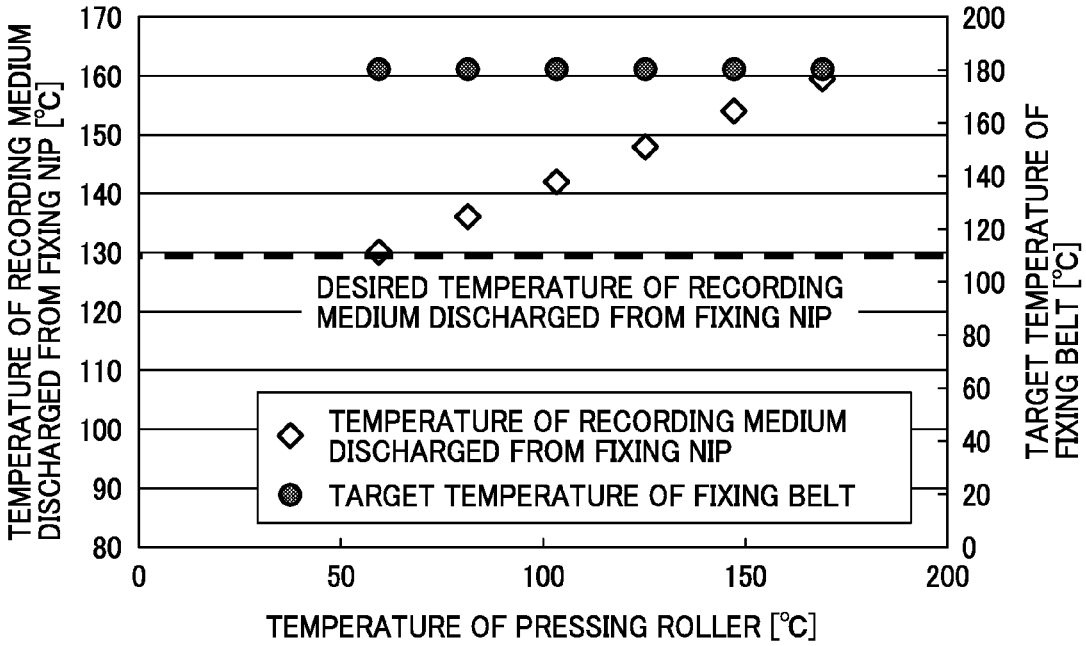
FIG. 17 is a graph showing a relation between the temperature of the pressing roller and the temperature of the recording medium discharged from the fixing nip when a target fixing temperature is constant under a comparative control method.

FIG. 17 is a graph showing a relation between the temperature of the pressing roller 2 and the temperature of the recording medium 20 discharged from the fixing nip N when a target temperature of the fixing belt 3 is constant under a comparative control method. Under the comparative control method shown in FIG. 17, as the temperature of the pressing roller 2 increases, even if the target temperature of the fixing belt 3 is constant, the temperature of the recording medium 20 discharged from the fixing nip N increases. Accordingly, the temperature of the recording medium 20 discharged from the fixing nip N is not maintained at a substantially constant, desired temperature. Without controlling the temperature of the pressing roller 2 that may adversely affect the temperature of the recording medium 20 discharged from the fixing nip N, the temperature of the recording medium 20 discharged from the fixing nip N may not be maintained at a desired temperature constantly.

To address this circumstance, the temperature of the fixing belt 3 or the nip conveyance time may be controlled based on the temperature of the pressing roller 2. However, according to this example embodiment, the temperature of the fixing belt 3 that is sensitive to the temperature of the recording medium 20 and readily controllable is controlled to maintain the temperature of the recording medium 20 discharged from the fixing nip N at a desired temperature constantly. For example, the target temperature of the fixing belt 3 is changed based on the temperature of the pressing roller 2. If the temperature of the pressing roller 2 is relatively high, the target temperature of the fixing belt 3 is decreased. Conversely, if the temperature of the pressing roller 2 is relatively low, the target temperature of the fixing belt 3 is increased, thus adjusting the temperature of the recording medium 20 discharged from the fixing nip N to a desired temperature constantly.

Figure 18:
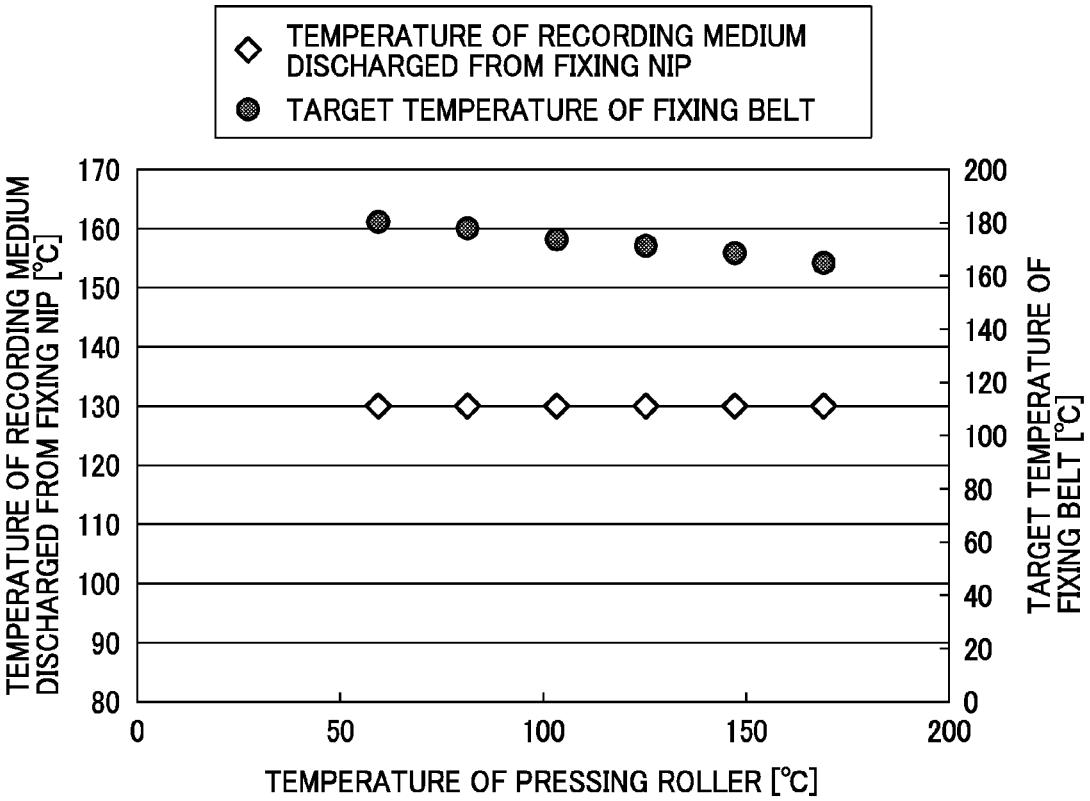
FIG. 18 is a graph showing a relation between the temperature of the pressing roller and the temperature of the recording medium discharged from the fixing nip and a relation between the temperature of the pressing roller and the target temperature of the fixing belt.

With reference to FIG. 18, a description is provided of a fixing device temperature control method for controlling the temperature of the fixing belt 3 based on the temperature of the pressing roller 2.

FIG. 18 is a graph showing a relation between the temperature of the pressing roller 2 and the temperature of the recording medium 20 discharged from the fixing nip N. FIG. 18 illustrates the temperature of the recording medium 20 discharged from the fixing nip N as the target temperature of the fixing belt 3 is controlled by correction based on the temperature of the pressing roller 2. For example, if the temperature of the pressing roller 2 is relatively high, the target temperature of the fixing belt 3 is decreased. Conversely, if the temperature of the pressing roller 2 is relatively low, the target temperature of the fixing belt 3 is increased, thus maintaining the temperature of the recording medium 20 discharged from the fixing nip N at a desired temperature.

Figure 19A:
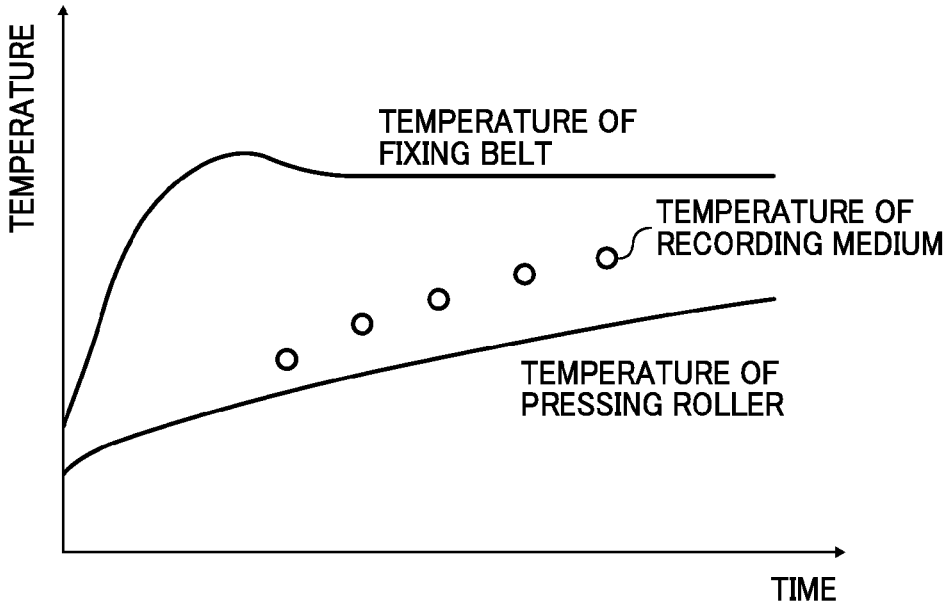
FIG. 19A is a graph showing a relation between time and the temperature of the recording medium when the plurality of recording media is conveyed through the fixing nip under the comparative control method to maintain the temperature of the fixing belt at a target temperature.
Figure 19B:
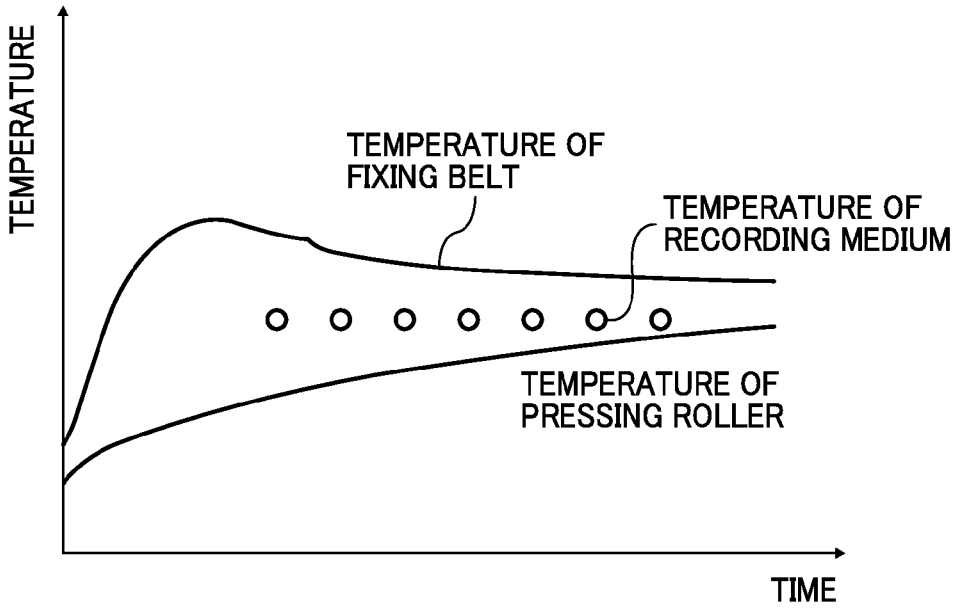
FIG. 19B is a graph showing a relation between time and the temperature of the recording medium when the plurality of recording media is conveyed through the fixing nip under a fixing device temperature control method according to the example embodiment, involving changing the target temperature of the fixing belt based on the temperature of the pressing roller.

With reference to FIGS. 19A and 19B, a description is provided of advantages of the fixing device temperature control method for controlling the temperature of the fixing belt 3 based on the temperature of the pressing roller 2.

FIG. 19A is a graph showing a relation between time and the temperature of the recording medium 20 when the plurality of recording media 20 is conveyed through the fixing nip N continuously under the comparative control method to maintain the temperature of the fixing belt 3 at a target temperature. FIG. 19B is a graph showing a relation between time and the temperature of the recording medium 20 when the plurality of recording media 20 is conveyed through the fixing nip N continuously under the fixing device temperature control method according to this example embodiment, involving changing the target temperature of the fixing belt 3 based on the temperature of the pressing roller 2.

If the image forming apparatus 400 is an intermediate-speed machine configured to convey recording media 20 at a speed of 30 to 60 sheets of A4 size per minute, for example, the image forming apparatus 400 may frequently convey the plurality of recording media 20 continuously. In this case, the temperature of the pressing roller 2 may change over time. Under the comparative control method shown in FIG. 19A, during a print job for forming a toner image T on a plurality of recording media 20 continuously, the pressing roller 2 stores a decreased amount of heat and therefore has a decreased temperature immediately after the print job starts. Accordingly, the recording medium 20 brought into contact with the pressing roller 2 having the decreased temperature also has a decreased temperature when it is discharged from the fixing nip N. Conversely, the pressing roller 2 stores an increased amount of heat and therefore has an increased temperature when the print job almost finishes. Accordingly, the recording medium 20 brought into contact with the pressing roller 2 having the increased temperature also has an increased temperature when it is discharged from the fixing nip N. Consequently, quality for fixing the toner image T on the recording media 20 may vary, i.e., deteriorate.

To address this circumstance, according to this example embodiment shown in FIG. 19B, even if the temperature of the pressing roller 2 increases gradually during the print job for printing on the plurality of recording media 20 continuously, the temperature of the fixing belt 3 is decreased to offset the increased temperature of the pressing roller 2, maintaining the temperature of the recording media 20 at a target temperature and therefore achieving the desired quality for fixing the toner image T on the recording media 20 and saving energy. Since the temperature of the recording medium 20 discharged from the fixing nip N is adjusted to a substantially constant temperature during the print job for printing on the plurality of recording media 20 continuously, a substantially constant fixing quality is assured in the first half and the second half of the print job, reducing energy consumption of the fixing device 22 in the second half of the print job.

Figure 20:
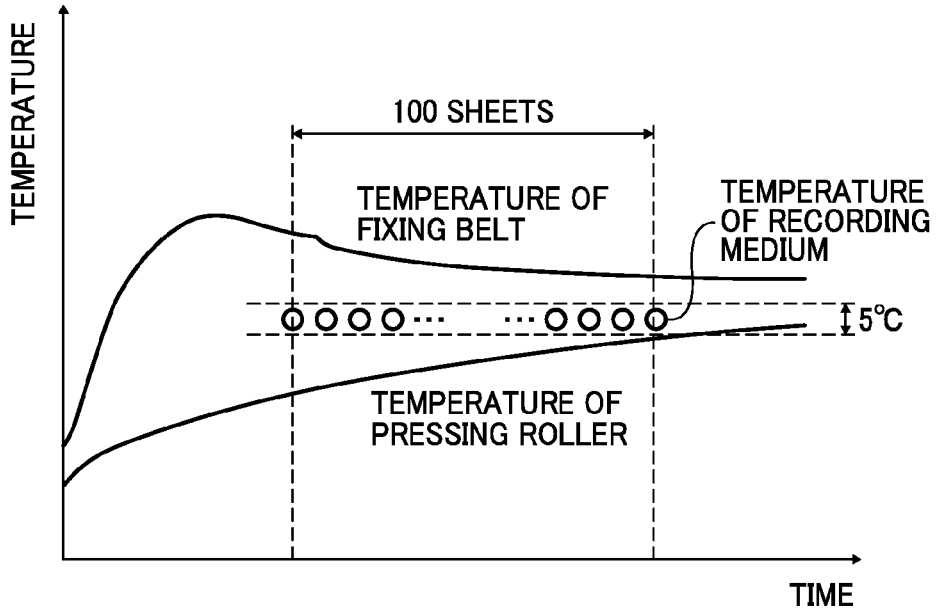
FIG. 20 is a graph showing a relation between time and the temperature of the recording medium when 100 sheets of recording media is conveyed through the fixing nip under the fixing device temperature control method according to the example embodiment, involving changing the target temperature of the fixing belt based on the temperature of the pressing roller.

With reference to FIG. 20, a description is provided of an evaluation of a print job for printing on 100 sheets of recording media 20 continuously under the fixing device temperature control method according to this example embodiment.

FIG. 20 is a graph showing a relation between time and the temperature of the recording medium 20 when 100 sheets of recording media 20 are conveyed through the fixing nip N under the fixing device temperature control method according to this example embodiment, involving changing the target temperature of the fixing belt 3 based on the temperature of the pressing roller 2.

In typical offices, a print job for printing on thousands of sheets is rarely performed. Accordingly, the evaluation was conducted for a print job for printing on 100 sheets, which is generally performed, to achieve precise evaluation results. Further, the temperature of the recording medium 20 discharged from the fixing nip N was controlled to within 5 degrees centigrade of a target temperature. For example, in a print job for printing on 100 sheets of non-coated paper continuously, the temperature of the fixing belt 3 is adjusted based on the temperature or heat storage of the pressing roller 2 to maintain the temperature of the recording medium 20 discharged from the fixing nip N within 5 degrees centigrade of the target temperature, achieving a substantially constant fixing quality in the first half and the second half of the print job and reducing energy consumption of the fixing device 22 in the second half of the print job.

A detailed description is now given of fluctuation within 5 degrees centigrade from the target temperature.

An experiment was conducted to examine how change in gloss of a toner image T formed on a recording medium 20 was identified. Printing was performed under conditions shown in table 1 below to obtain samples.

TABLE 1

| | |
|---|---|
| Ambient temperature | 23 degrees centigrade |
| Nip conveyance time | 45 ms |
| Recording medium type | Coated paper having paper weight of 180 g/m$^2$ |
| Toner type | Polyester polymerization black toner |
| Material of surface of fixing belt 3 | Tetrafluoroethylene-perfluoroalkylvinylether copolymer (PFA) |

Samples having different gloss levels were prepared under the conditions shown in table 1. For example, the fixing belt 3 was heated to a target temperature and left for about 15 minutes until the entire fixing device 22 stored heat sufficiently. After a toner image T was fixed on a recording medium 20 while the recording medium 20 was conveyed through the fixing nip N, the gloss level was measured with a gloss meter. Specifically, incident light was emitted onto the toner image T on the recording medium 20 at an incident angle of 60 degrees and reflection light reflected by the toner image T was measured with the gloss meter. The incident angle of 60 degrees is generally used for evaluation conducted with the image forming apparatus 400 used in typical offices. The gloss meter was a Uni Gross 60 available from Konica Minolta, Inc. The target temperature of the fixing belt 3 was changed gradually to produce the samples having different gloss levels. Three samples were evaluated subjectively by a plurality of subjective evaluators on whether or not the different gloss levels were identifiable.

Figure 21:
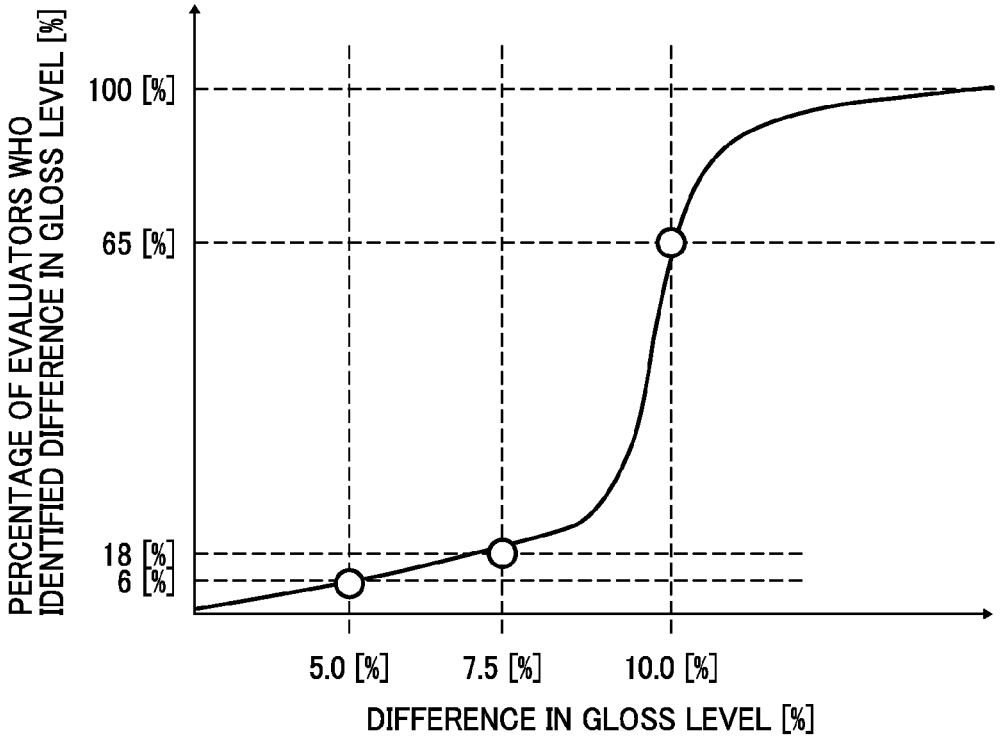
FIG. 21 is a graph showing a relation between the difference in gloss level of samples and the percentage of evaluators who identified the difference in gloss level.

Evaluation results are shown in FIG. 21. FIG. 21 is a graph showing a relation between the difference in gloss level of the samples and the percentage of the evaluators who identified the difference in gloss level.

As shown in FIG. 21, three samples having the differences in gloss level of 5.0 percent, 7.5 percent, and 10.0 percent, respectively, were produced and evaluated. The percentage of evaluators who identified the difference in gloss level was 18 percent for the difference in gloss level of 7.5 percent. Conversely, it was 65 percent for the difference in gloss level of 10.0 percent. That is, it substantially increases between the differences in gloss level of 7.5 percent and 10.0 percent. Accordingly, the change in gloss level may be below the threshold of 7.5 percent to improve quality for fixing the toner image T on the recording medium 20. On the other hand, in view of the relation between the temperature of the recording medium 20 discharged from the fixing nip N and the gloss level of the toner image T on the recording medium 20 shown in FIG. 13, in order to restrict the change in gloss level to or below the threshold of 7.5 percent, the change or fluctuation in temperature of the recording medium 20 discharged from the fixing nip N should be within 5 degrees centigrade.

According to this example embodiment, after the temperature of the recording medium 20 discharged from the fixing nip N was maintained substantially at a target temperature during a print job for printing on 100 sheets continuously, fluctuation in temperature of the recording medium 20 discharged from the fixing nip N was within 5 degrees centigrade as shown in FIG. 20.

With reference to FIGS. 22 to 29B, a description is provided of a correction method for correcting for the effect of the temperature of the pressing roller 2 on the temperature of the recording medium 20 discharged from the fixing nip N.

The effect exerted by the temperature of the pressing roller 2 on the temperature of the recording medium 20 varies depending on properties such as the nip conveyance time, the paper weight, the thermal conductivity, the specific heat, and the moisture content of the recording medium 20. Accordingly, the gradient of the target temperature of the fixing belt 3 with respect to the temperature of the pressing roller 2 to maintain the temperature of the recording medium 20 discharged from the fixing nip N at a constant temperature as shown in FIG. 18 may be corrected by those properties.

A detailed description is now given of the correction method for correcting for the effect of the temperature of the pressing roller 2 on the temperature of the recording medium 20 discharged from the fixing nip N.

Figure 22:
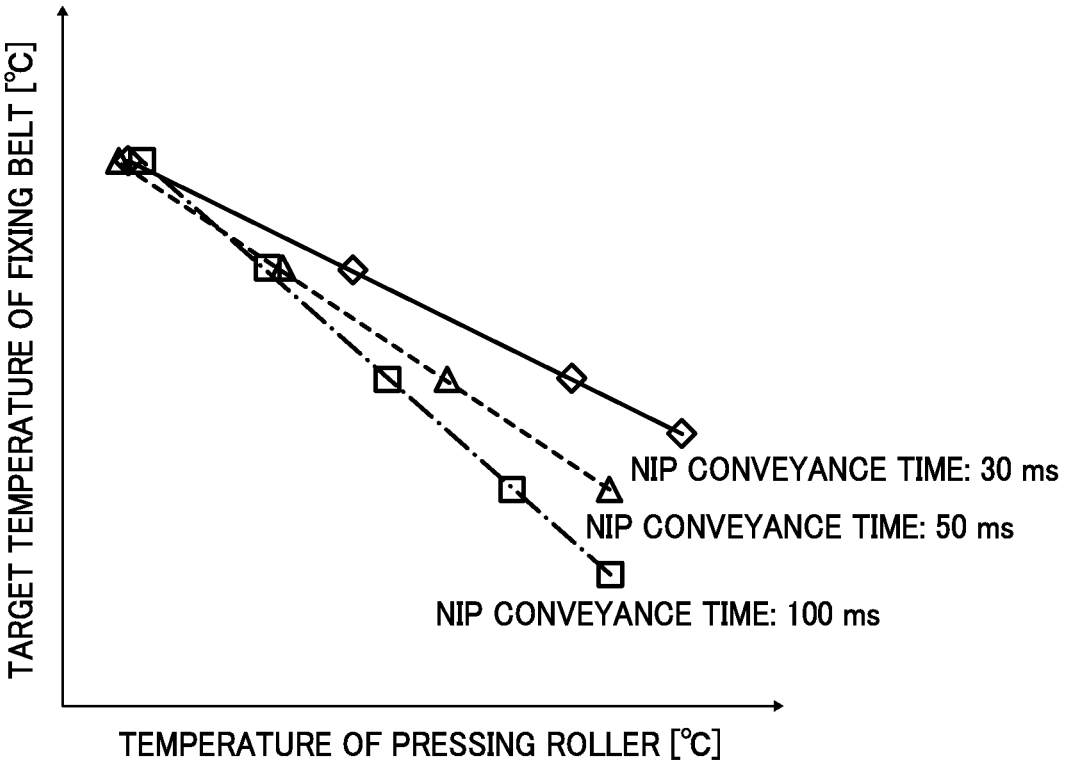
FIG. 22 is a graph showing a relation between the temperature of the pressing roller and the target temperature of the fixing belt that achieves an identical temperature of the recording medium discharged from the fixing nip.
Figure 23A:
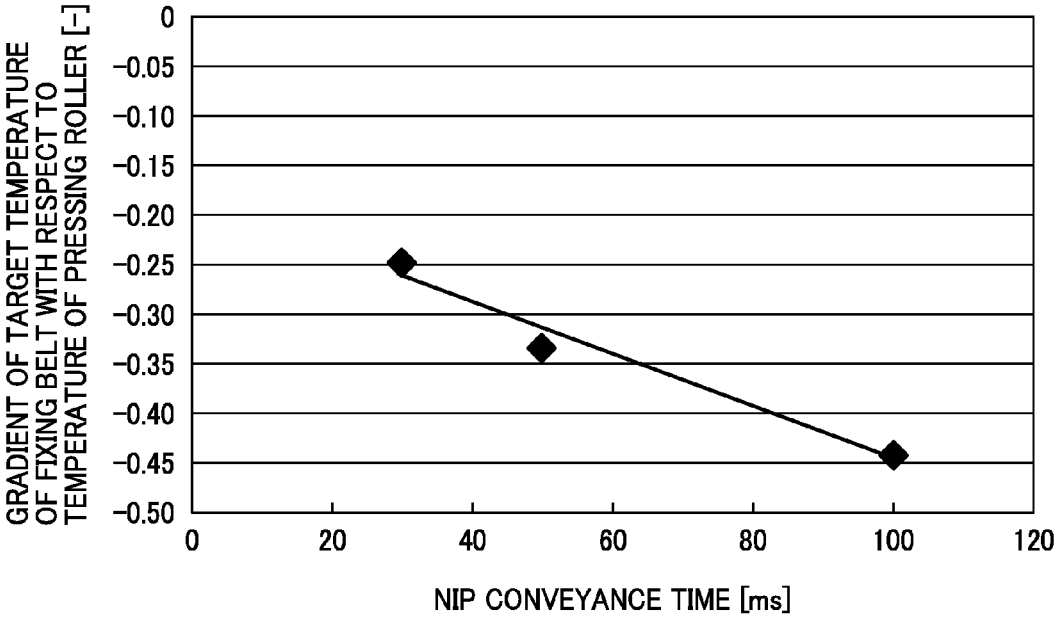
FIG. 23A is a graph showing a relation between the nip conveyance time and the gradient of the target temperature of the fixing belt with respect to the temperature of the pressing roller.
Figure 23B:
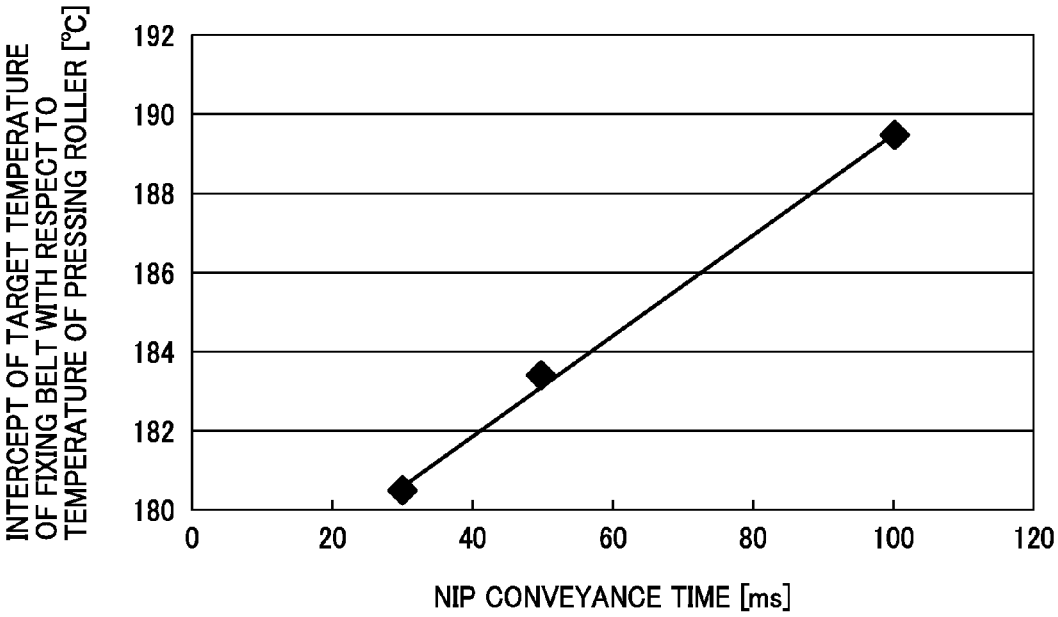
FIG. 23B is a graph showing a relation between the nip conveyance time and the intercept of the target temperature of the fixing belt with respect to the temperature of the pressing roller.

With reference to FIGS. 22 to 23B, a description is provided of one example of the correction method in view of the nip conveyance time. The nip conveyance time also varies depending on the operating condition of the fixing device 22. For example, as the fixing belt 3 stores more heat, the fixing roller 1 and the fixing belt 3 may expand thermally, changing the fixing nip width W of the fixing nip N depicted in FIG. 2.

How the nip conveyance time changes the effect exerted by the temperature of the pressing roller 2 on the temperature of the recording medium 20 discharged from the fixing nip N was examined by experiment and simulation.

FIG. 22 is a graph showing a relation between the temperature of the pressing roller 2, the target temperature of the fixing belt 3, and the nip conveyance time that achieves a substantially constant temperature of the recording medium 20 discharged from the fixing nip N. Examination was conducted for the nip conveyance time of 30 ms, 50 ms, and 100 ms.

The paper weight of the recording medium 20 was 70 g/m$^2$. The thermal conductivity of the recording medium 20 was 0.16 W/(m·K). The specific heat of the recording medium 20 was 1,012 KJ/(m$^3$·K). The temperature of the recording medium 20 before entering the fixing nip N was 23 degrees centigrade. The moisture content of the recording medium 20 was 4 percent. As shown in FIG. 22, the gradient of the line for the nip conveyance time of 50 ms is greater than that for the nip conveyance time of 30 ms. The gradient of the line for the nip conveyance time of 100 ms is greater than that for the nip conveyance time of 50 ms. That is, as the nip conveyance time increases, the gradient of the lines increases.

The gradient of the lines indicates the effect exerted on the temperature of the recording medium 20 discharged from the fixing nip N by the temperature of the pressing roller 2. The greater the nip conveyance time, the greater the effect exerted on the temperature of the recording medium 20 discharged from the fixing nip N by the temperature of the pressing roller 2. It is assumed that as the nip conveyance time increases, the pressing roller 2 conducts an increased amount of heat to the recording medium 20.

FIG. 23A is a graph showing a relation between the nip conveyance time depicted in FIG. 22 and the gradient of the target temperature of the fixing belt 3 with respect to the temperature of the pressing roller 2. FIG. 23B is a graph showing a relation between the nip conveyance time depicted in FIG. 22 and the intercept of the target temperature of the fixing belt 3 with respect to the temperature of the pressing roller 2. As shown in FIGS. 23A and 23B, the nip conveyance time shows a strong correlation with the gradient and the intercept of the target temperature of the fixing belt 3 with respect to the temperature of the pressing roller 2, drawing approximate lines by regression analysis.

A coefficient of the two approximate lines is obtained in advance and stored in a memory. From the gradient and the intercept of the target temperature of the fixing belt 3 with respect to the temperature of the pressing roller 2 indicated by the two approximate lines in FIGS. 23A and 23B, two formulas (2) and (3) below are obtained and coefficients of the formulas (2) and (3) are stored in the memory.

$$y1=-0.0027\cdot x-0.1812 \quad (2)$$

$$y2=0.1282\cdot x+176.7 \quad (3)$$

In the formulas (2) and (3), x represents the nip conveyance time, y1 represents the gradient of the target temperature of the fixing belt 3 with respect to the temperature of the pressing roller 2, and y2 represents the intercept of the target temperature of the fixing belt 3 with respect to the temperature of the pressing roller 2.

Since the nip conveyance time x determines the gradient y1 and the intercept y2, a line indicating the target temperature of the fixing belt 3 with respect to the temperature of the pressing roller 2 is shown by a formula (4) below.

$$Y=y1\cdot x+y2 \quad (4)$$

The nip conveyance time may be measured by using a sensor or calculated based on heat storage of the fixing belt 3 and the pressing roller 2. Accordingly, the lines indicating the target temperature of the fixing belt 3 with respect to the temperature of the pressing roller 2 are obtained for different nip conveyance times as shown in FIG. 22. If a sensor (e.g., the temperature sensor 7 depicted in FIG. 2) is configured to detect the temperature of the pressing roller 2, the target temperature of the fixing belt 3 is determined based on the lines shown in FIG. 22. Based on the temperature of the pressing roller 2 detected by the temperature sensor 7, the fixing temperature controller 92*a* depicted in FIG. 2 adjusts a time for energizing the heaters of the halogen heater set 5 (e.g., the first halogen heater 5*a*, the second halogen heater 5*b*, and the third halogen heater 5*c* depicted in FIG. 3) and the resistance heat generator set 5S (e.g., the resistance heat generators 5Sa to 5Sh depicted in FIG. 4), controlling the target temperature of the fixing belt 3 by feedback and thereby approximating the temperature of the recording medium 20 to a target temperature. Accordingly, the temperature of the recording medium 20 discharged from the fixing nip N is maintained at a substantially constant target temperature, achieving a substantially constant, high quality fixing. Consequently, the fixing device temperature control method, for controlling the temperature of the fixing belt 3 based on the temperature of the pressing roller 2, by considering the nip conveyance time, corrects the effect of the temperature of the pressing roller 2 on the temperature of the recording medium 20 discharged from the fixing nip N. It is to be noted that the fixing temperature controller 92*a* may be a feedback controller or a feed forward controller.

Similarly by using the above-described correction method for correcting for the effect of the temperature of the pressing roller 2 on the temperature of the recording medium 20 discharged from the fixing nip N applied to the nip conveyance time, for the properties other than the nip conveyance time for correcting the effect of the temperature of the pressing roller 2 on the temperature of the recording medium 20 discharged from the fixing nip N, the lines indicating the target temperature of the fixing belt 3 with respect to the temperature of the pressing roller 2 that consider different values of each property are obtained. Hence, the effect of the temperature of the pressing roller 2 on the temperature of the recording medium 20 discharged from the fixing nip N is corrected by considering each property. Accordingly, a description is provided of the correction method applied to the paper weight, the thermal conductivity, the specific heat, and the moisture content of the recording medium 20 as the properties.

Figure 24:
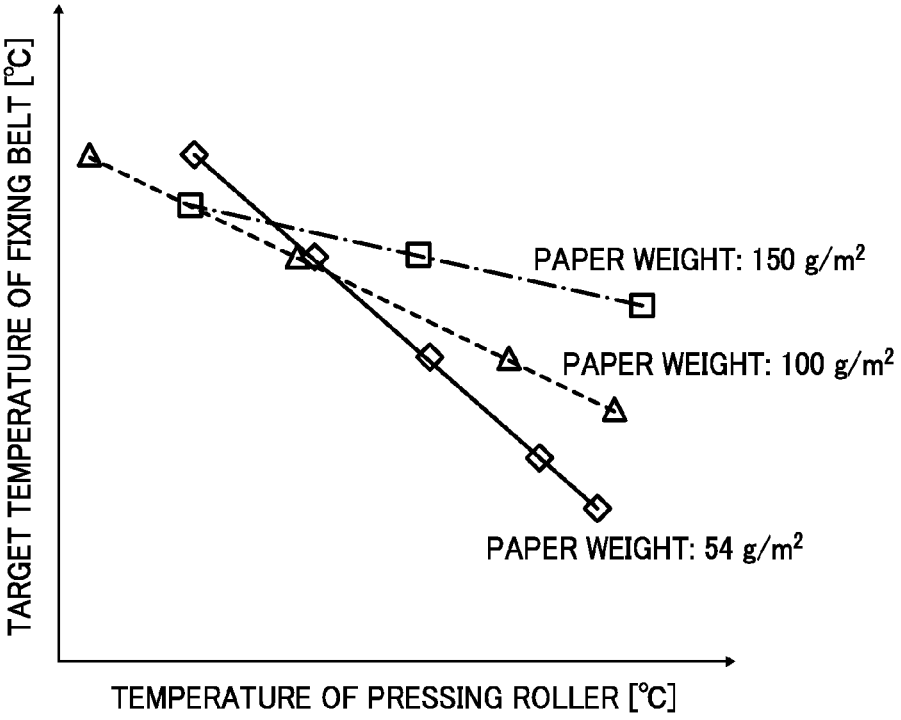
FIG. 24 is a graph showing a relation between the temperature of the pressing roller and the target temperature of the fixing belt that achieves an identical temperature of the recording medium discharged from the fixing nip when the paper weight of the recording medium varies.

With reference to FIG. 24, a detailed description is now given of the correction method for correcting for the effect of the temperature of the pressing roller 2 on the temperature of the recording medium 20 discharged from the fixing nip N that is applied to the paper weight of the recording medium 20.

How the paper weight of the recording medium 20 changes the effect exerted by the temperature of the pressing roller 2 on the temperature of the recording medium 20 discharged from the fixing nip N was examined by experiment and simulation.

FIG. 24 is a graph showing a relation between the temperature of the pressing roller 2 and the target temperature of the fixing belt 3 that achieves a substantially constant temperature of the recording medium 20 discharged from the fixing nip N for three paper weights. The three paper weights of the recording medium 20 were 150 g/m$^2$, 100 g/m$^2$, and 54 g/m$^2$. The nip conveyance time was 50 ms. The thermal conductivity of the recording medium 20 was 0.16 W/(m·K). The specific heat of the recording medium 20 was 1,012 KJ/(m$^3$·K). The temperature of the recording medium 20 before entering the fixing nip N was 23 degrees centigrade. The moisture content of the recording medium 20 was 4 percent.

As shown in FIG. 24, the gradient of the line for the paper weight of 100 g/m$^2$ is greater than that for the paper weight of 150 g/m$^2$. The gradient of the line for the paper weight of 54 g/m$^2$ is greater than that for the paper weight of 100 g/m$^2$. That is, as the paper weight of the recording medium 20 decreases, the gradient of the lines increases. Hence, the smaller the paper weight of the recording medium 20, the greater the effect exerted by the temperature of the pressing roller 2 on the temperature of the recording medium 20 discharged from the fixing nip N. It is assumed that as the paper weight of the recording medium 20 decreases, the pressing roller 2 conducts heat to the recording medium 20 more quickly.

Accordingly, data about the effect exerted by the temperature of the pressing roller 2 on the temperature of the recording medium 20 discharged from the fixing nip N that varies depending on the paper weight of the recording medium 20 is obtained in advance by experiment or simulation as shown in FIG. 24. Using the data, based on the temperature of the pressing roller 2 detected by the temperature sensor 7, the fixing temperature controller 92*a* adjusts a time for energizing the heaters of the halogen heater set 5 (e.g., the first halogen heater 5*a*, the second halogen heater 5*b*, and the third halogen heater 5*c* depicted in FIG. 3) and the resistance heat generator set 5S (e.g., the resistance heat generators 5Sa to 5Sh depicted in FIG. 4), controlling the target temperature of the fixing belt 3 by feedback and thereby approximating the temperature of the recording medium 20 to a target temperature. Accordingly, the temperature of the recording medium 20 discharged from the fixing nip N is maintained at a substantially constant temperature, achieving a substantially constant, high quality fixing. Consequently, the fixing device temperature control method for controlling the temperature of the fixing belt 3 based on the temperature of the pressing roller 2, by considering the paper weight of the recording medium 20, corrects the effect of the temperature of the pressing roller 2 on the temperature of the recording medium 20 discharged from the fixing nip N.

Figure 25:
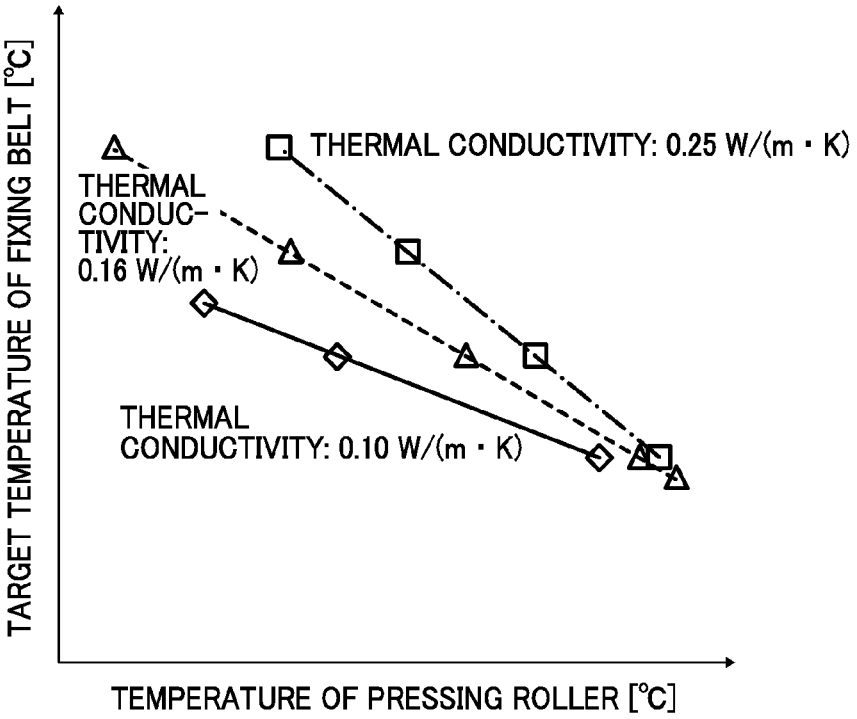
FIG. 25 is a graph showing a relation between the temperature of the pressing roller and the target temperature of the fixing belt that achieves an identical temperature of the recording medium discharged from the fixing nip when the thermal conductivity of the recording medium varies.

With reference to FIG. 25, a detailed description is now given of the correction method for correcting for the effect of the temperature of the pressing roller 2 on the temperature of the recording medium 20 discharged from the fixing nip N that is applied to the thermal conductivity of the recording medium 20.

How the thermal conductivity of the recording medium 20 changes the effect exerted by the temperature of the pressing roller 2 on the temperature of the recording medium 20 discharged from the fixing nip N was examined by experiment and simulation.

FIG. 25 is a graph showing a relation between the temperature of the pressing roller 2 and the target temperature of the fixing belt 3 that achieves a substantially constant temperature of the recording medium 20 discharged from the fixing nip N for three thermal conductivities. The three thermal conductivities were 0.25 W/(m·K), 0.16 W/(m·K), and 0.10 W/(m·K). The nip conveyance time was 50 ms. The paper weight of the recording medium 20 was 70 g/m$^2$. The specific heat of the recording medium 20 was 1,012 KJ/(m$^3$·K). The temperature of the recording medium 20 before entering the fixing nip N was 23 degrees centigrade. The moisture content of the recording medium 20 was 4 percent.

As shown in FIG. 25, the gradient of the line for the thermal conductivity of 0.16 W/(m·K) is greater than that for the thermal conductivity of 0.10 W/(m·K). The gradient of the line for the thermal conductivity of 0.25 W/(m·K) is greater than that for the thermal conductivity of 0.16 W/(m·K). That is, as the thermal conductivity of the recording medium 20 increases, the gradient of the lines increases. Hence, the greater the thermal conductivity of the recording medium 20, the greater the effect exerted by the temperature of the pressing roller 2 on the temperature of the recording medium 20 discharged from the fixing nip N. It is assumed that as the thermal conductivity of the recording medium 20 increases, the pressing roller 2 conducts heat to the recording medium 20 more quickly.

Accordingly, data about the effect exerted by the temperature of the pressing roller 2 on the temperature of the recording medium 20 discharged from the fixing nip N that varies depending on the thermal conductivity of the recording medium 20 is obtained in advance by experiment or simulation as shown in FIG. 25. Using the data, based on the temperature of the pressing roller 2 detected by the temperature sensor 7, the fixing temperature controller 92*a* adjusts a time for energizing the heaters of the halogen heater set 5 (e.g., the first halogen heater 5*a*, the second halogen heater 5*b*, and the third halogen heater 5*c* depicted in FIG. 3) and the resistance heat generator set 5S (e.g., the resistance heat generators 5Sa to 5Sh depicted in FIG. 4), controlling the target temperature of the fixing belt 3 by feedback and thereby approximating the temperature of the recording medium 20 discharged from the fixing nip N to a target temperature. Accordingly, the temperature of the recording medium 20 discharged from the fixing nip N is maintained at a substantially constant temperature, achieving a substantially constant, high quality fixing. Consequently, the fixing device temperature control method for controlling the temperature of the fixing belt 3 based on the temperature of the pressing roller 2, by considering the thermal conductivity of the recording medium 20, corrects the effect of the temperature of the pressing roller 2 on the temperature of the recording medium 20 discharged from the fixing nip N.

Figure 26:
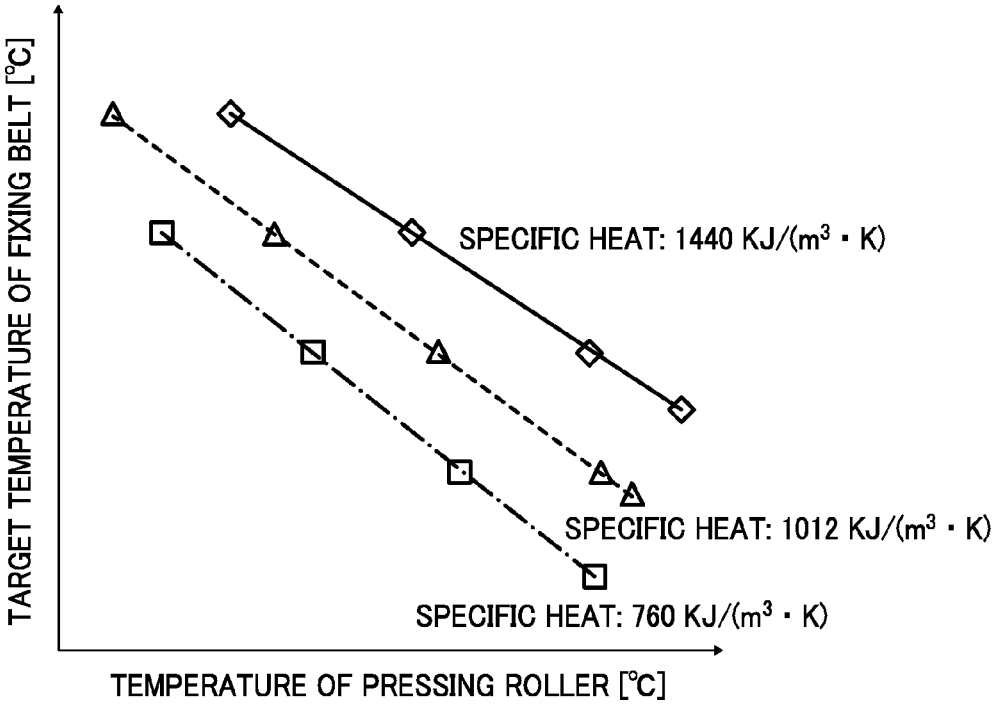
FIG. 26 is a graph showing a relation between the temperature of the pressing roller and the target temperature of the fixing belt that achieves an identical temperature of the recording medium discharged from the fixing nip when the specific heat of the recording medium varies.

With reference to FIG. 26, a detailed description is now given of the correction method for correcting for the effect of the temperature of the pressing roller 2 on the temperature of the recording medium 20 discharged from the fixing nip N that is applied to the specific heat of the recording medium 20.

How the specific heat of the recording medium 20 changes the effect exerted by the temperature of the pressing roller 2 on the temperature of the recording medium 20 discharged from the fixing nip N was examined by experiment and simulation.

FIG. 26 is a graph showing a relation between the temperature of the pressing roller 2 and the target temperature of the fixing belt 3 that achieves a substantially constant temperature of the recording medium 20 discharged from the fixing nip N for three specific heats. The three specific heats of the recording medium 20 were 1,440 KJ/(m$^3$·K), 1,012 KJ/(m$^3$·K), and 760 KJ/(m$^3$·K). The nip conveyance time was 50 ms. The paper weight of the recording medium 20 was 70 g/m$^2$. The thermal conductivity of the recording medium 20 was 0.16 W/(m·K). The temperature of the recording medium 20 before entering the fixing nip N was 23 degrees centigrade. The moisture content of the recording medium 20 was 4 percent.

As shown in FIG. 26, the gradient of the line for the specific heat of 1,012 KJ/(m$^3$·K) is greater than that for the specific heat of 1,440 KJ/(m$^3$·K). The gradient of the line for the specific heat of 760 KJ/(m$^3$·K) is greater than that for the specific heat of 1,012 KJ/(m$^3$·K). That is, as the specific heat of the recording medium 20 decreases, the gradient of the lines increases slightly. Hence, the smaller the specific heat of the recording medium 20, the greater the effect exerted by the temperature of the pressing roller 2 on the temperature of the recording medium 20 discharged from the fixing nip N. It is assumed that as the specific heat of the recording medium 20 decreases, the pressing roller 2 conducts heat to the recording medium 20 more quickly.

Accordingly, data about the effect exerted by the temperature of the pressing roller 2 on the temperature of the recording medium 20 discharged from the fixing nip N that varies depending on the specific heat of the recording medium 20 is obtained in advance by experiment or simulation as shown in FIG. 26. Using the data, based on the temperature of the pressing roller 2 detected by the temperature sensor 7, the fixing temperature controller 92*a* adjusts a time for energizing the heaters of the halogen heater set 5 (e.g., the first halogen heater 5*a*, the second halogen heater 5*b*, and the third halogen heater 5*c* depicted in FIG. 3) and the resistance heat generator set 5S (e.g., the resistance heat generators 5Sa to 5Sh depicted in FIG. 4), controlling the target temperature of the fixing belt 3 by feedback and thereby approximating the temperature of the recording medium 20 discharged from the fixing nip N to a target temperature. Accordingly, the temperature of the recording medium 20 discharged from the fixing nip N is maintained at a substantially constant temperature, achieving a substantially constant, high quality fixing. Consequently, the fixing device temperature control method for controlling the temperature of the fixing belt 3 based on the temperature of the pressing roller 2, by considering the specific heat of the recording medium 20, corrects the effect of the temperature of the pressing roller 2 on the temperature of the recording medium 20 discharged from the fixing nip N.

Figure 27:
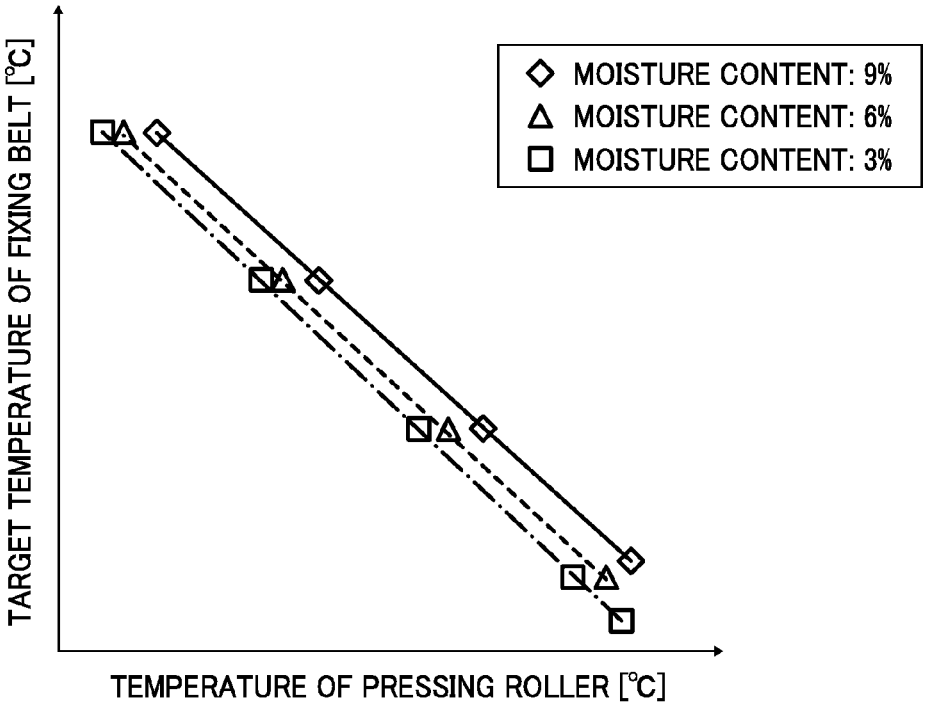
FIG. 27 is a graph showing a relation between the temperature of the pressing roller and the target temperature of the fixing belt that achieves an identical temperature of the recording medium discharged from the fixing nip when the moisture content of the recording medium varies.

With reference to FIG. 27, a detailed description is now given of the correction method for correcting for the effect of the temperature of the pressing roller 2 on the temperature of the recording medium 20 discharged from the fixing nip N that is applied to the moisture content of the recording medium 20 before entering the fixing nip N.

How the moisture content of the recording medium 20 changes the effect exerted by the temperature of the pressing roller 2 on the temperature of the recording medium 20 discharged from the fixing nip N was examined by experiment and simulation.

FIG. 27 is a graph showing a relation between the temperature of the pressing roller 2 and the target temperature of the fixing belt 3 that achieves a substantially constant temperature of the recording medium 20 discharged from the fixing nip N for three moisture contents. The three moisture contents of the recording medium 20 were 9 percent, 6 percent, and 3 percent. The nip conveyance time was 50 ms. The paper weight of the recording medium 20 was 80 g/m$^2$. The thermal conductivity of the recording medium 20 was 0.16 W/(m·K). The specific heat of the recording medium 20 was 1,012 KJ/(m$^3$·K). The temperature of the recording medium 20 before entering the fixing nip N was 23 degrees centigrade.

As shown in FIG. 27, the gradient of the line for the moisture content of 6 percent is greater than that for the moisture content of 9 percent. The gradient of the line for the moisture content of 3 percent is greater than that for the moisture content of 6 percent. That is, as the moisture content of the recording medium 20 decreases, the gradient of the lines increases slightly. Hence, the smaller the moisture content of the recording medium 20, the greater the effect of the temperature of the pressing roller 2 on the temperature of the recording medium 20 discharged from the fixing nip N. It is assumed that as the moisture content of the recording medium 20 decreases, the pressing roller 2 conducts heat to the recording medium 20 with an increased, apparent thermal conductivity.

Accordingly, data about the effect exerted by the temperature of the pressing roller 2 on the temperature of the recording medium 20 discharged from the fixing nip N that varies depending on the moisture content of the recording medium 20 is obtained in advance by experiment or simulation as shown in FIG. 27. Using the data, based on the temperature of the pressing roller 2 detected by the temperature sensor 7, the fixing temperature controller 92*a* adjusts a time for energizing the heaters of the halogen heater set 5 (e.g., the first halogen heater 5*a*, the second halogen heater 5*b*, and the third halogen heater 5*c* depicted in FIG. 3) and the resistance heat generator set 5S (e.g., the resistance heat generators 5Sa to 5Sh depicted in FIG. 4), controlling the target temperature of the fixing belt 3 by feedback and thereby approximating the temperature of the recording medium 20 discharged from the fixing nip N to a target temperature. Accordingly, the temperature of the recording medium 20 discharged from the fixing nip N is maintained at a substantially constant temperature, achieving a substantially constant, high quality fixing. Consequently, the fixing device temperature control method for controlling the temperature of the fixing belt 3 based on the temperature of the pressing roller 2, by considering the moisture content of the recording medium 20, corrects the effect of the temperature of the pressing roller 2 on the temperature of the recording medium 20 discharged from the fixing nip N.

As described above, the correction calculation of the temperature of the recording medium 20 discharged from the fixing nip N based on the temperature of the pressing roller 2 uses one of the five properties, that is, the nip conveyance time, the paper weight, the thermal conductivity, the specific heat, and the moisture content of the recording medium 20.

Accordingly, an amount of heat supplied from the heaters of the halogen heater set 5 (e.g., the first halogen heater 5*a*, the second halogen heater 5*b*, and the third halogen heater 5*c* depicted in FIG. 3) and the resistance heat generator set 5S (e.g., the resistance heat generators 5Sa to 5Sh depicted in FIG. 4) is calculated precisely, achieving a substantially constant, high quality fixing and reducing energy consumption of the fixing device 22.

According to the example embodiments described above, in view of one of the five properties, that is, the nip conveyance time, the paper weight, the thermal conductivity, the specific heat, and the moisture content of the recording medium 20, the effect exerted by the temperature of the pressing roller 2 on the temperature of the recording medium 20 is calculated, thus determining the target temperature of the fixing belt 3. Alternatively, by combination of two or more of the five properties, the temperature of the recording medium 20 discharged from the fixing nip N is calculated more precisely. As a result, the temperature of the recording medium 20 discharged from the fixing nip N is controlled within a decreased temperature range.

Figure 28A:
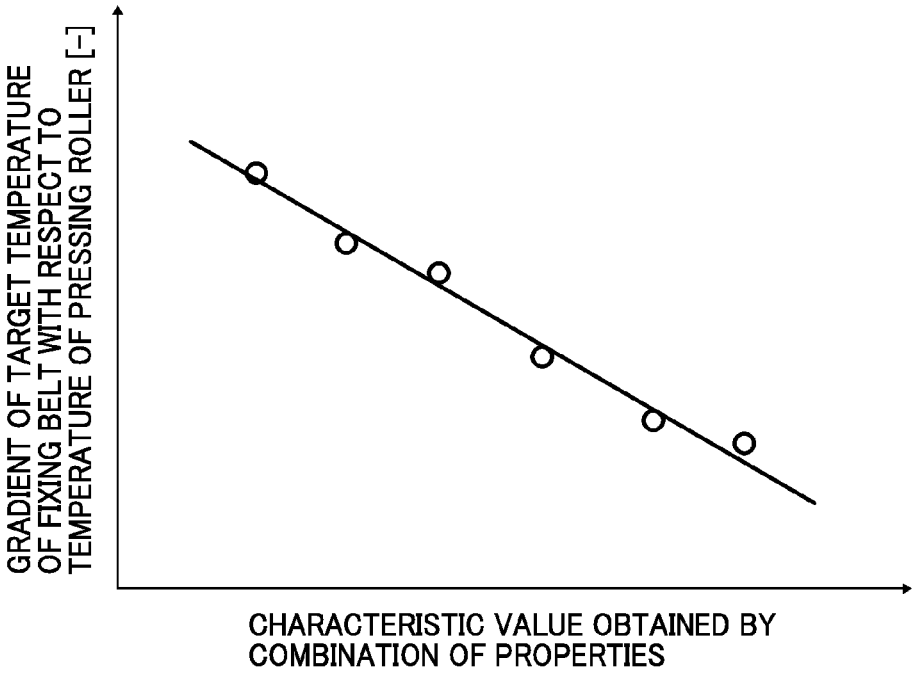
FIG. 28A is a graph showing a relation between the characteristic value obtained by combining two or more of five properties of the recording medium and the gradient of the target temperature of the fixing belt with respect to the temperature of the pressing roller.
Figure 28B:
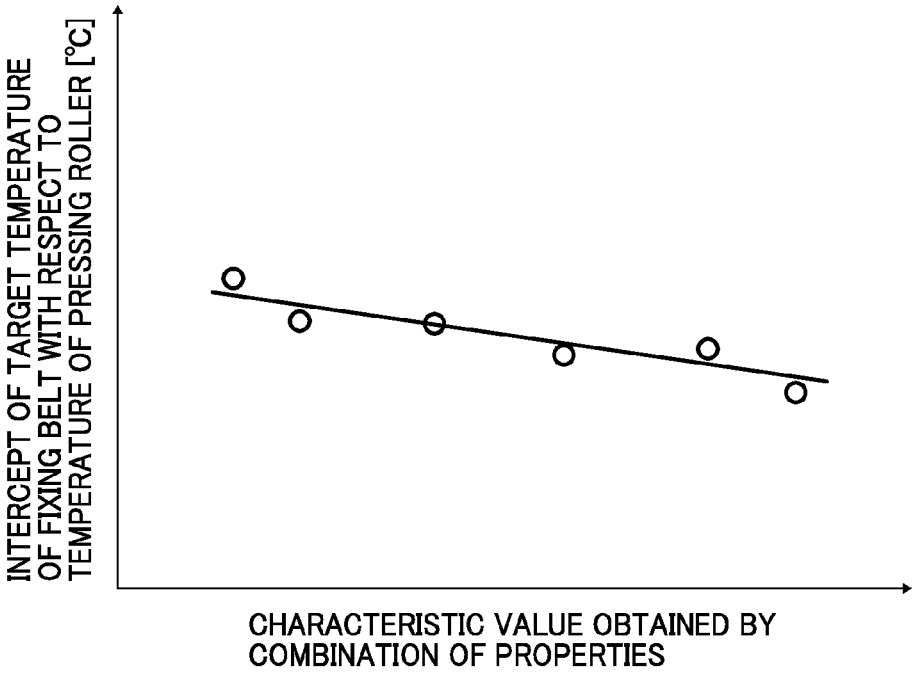
FIG. 28B is a graph showing a relation between the characteristic value obtained by combining two or more of five properties of the recording medium and the intercept of the target temperature of the fixing belt with respect to the temperature of the pressing roller.

With reference to FIGS. 28A and 28B, a description is provided of a correction control method for correcting for the effect of the temperature of the pressing roller 2 on the temperature of the recording medium 20 in view of two or more of the five properties.

A characteristic value is obtained by combining two or more properties. For example, the characteristic value is obtained by multiple regression analysis by considering the properties that may change the effect exerted by the temperature of the pressing roller 2 on the temperature of the recording medium 20. That is, the characteristic value that indicates the gradient and the intercept of the approximate line of the target temperature of the fixing belt 3 with respect to the pressing roller 2 is obtained.

FIG. 28A is a graph showing a relation between the characteristic value obtained by combining two or more of the five properties and the gradient of the target temperature of the fixing belt 3 with respect to the temperature of the pressing roller 2. FIG. 28B is a graph showing a relation between the characteristic value obtained by combining two or more of the five properties and the intercept of the target temperature of the fixing belt 3 with respect to the temperature of the pressing roller 2.

For example, by using the thermal conductivity and the paper weight of the recording medium 20, the characteristic value is obtained by dividing the thermal conductivity of the recording medium 20 by the paper weight of the recording medium 20 as below.

When the thermal conductivity of the recording medium 20 is 0.10 W/(m·K) and the paper weight of the recording medium 20 is 100 g/m$^2$, the characteristic value is 0.00100 kg$^2$/(m·s$^3$·K).

When the thermal conductivity of the recording medium 20 is 0.10 W/(m·K) and the paper weight of the recording medium 20 is 80 g/m$^2$, the characteristic value is 0.00125 kg$^2$/(m·s$^3$·K).

When the thermal conductivity of the recording medium 20 is 0.16 W/(m·K) and the paper weight of the recording medium 20 is 100 g/m$^2$, the characteristic value is 0.00160 kg$^2$/(m·s$^3$·K).

When the thermal conductivity of the recording medium 20 is 0.16 W/(m·K) and the paper weight of the recording medium 20 is 80 g/m$^2$, the characteristic value is 0.00200 kg$^2$/(m·s$^3$·K).

When the thermal conductivity of the recording medium 20 is 0.25 W/(m·K) and the paper weight of the recording medium 20 is 100 g/m$^2$, the characteristic value is 0.00250 kg$^2$/(m·s$^3$·K).

When the thermal conductivity of the recording medium 20 is 0.25 W/(m·K) and the paper weight of the recording medium 20 is 80 g/m$^2$, the characteristic value is 0.00313 kg$^2$/(m·s$^3$·K).

Figure 29A:
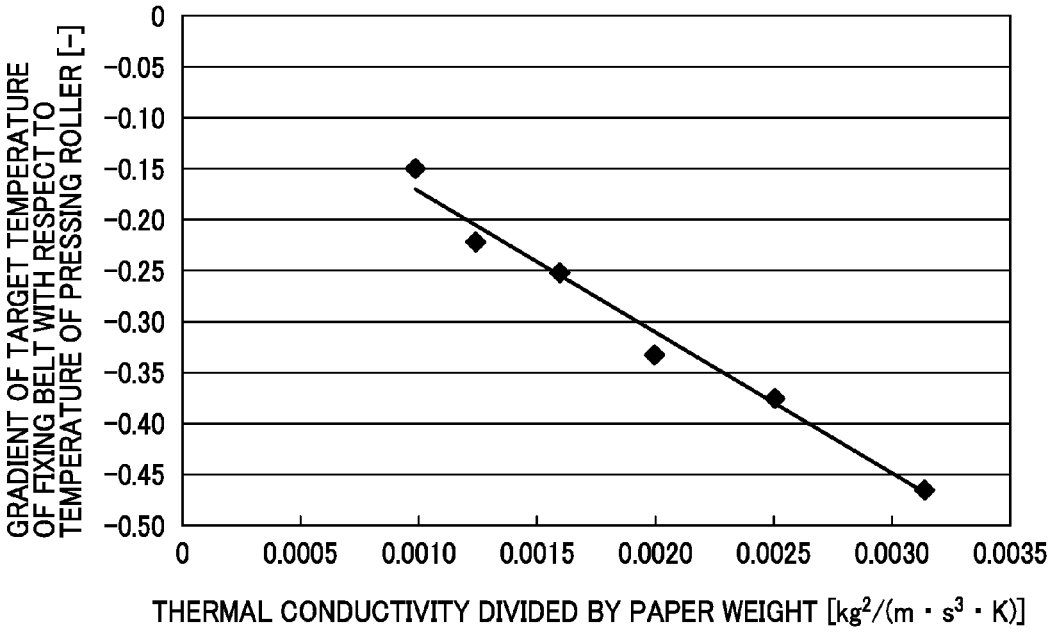
FIG. 29A is a graph showing a relation between the characteristic value obtained by dividing the thermal conductivity of the recording medium by the paper weight of the recording medium and the gradient of the target temperature of the fixing belt with respect to the temperature of the pressing roller.
Figure 29B:
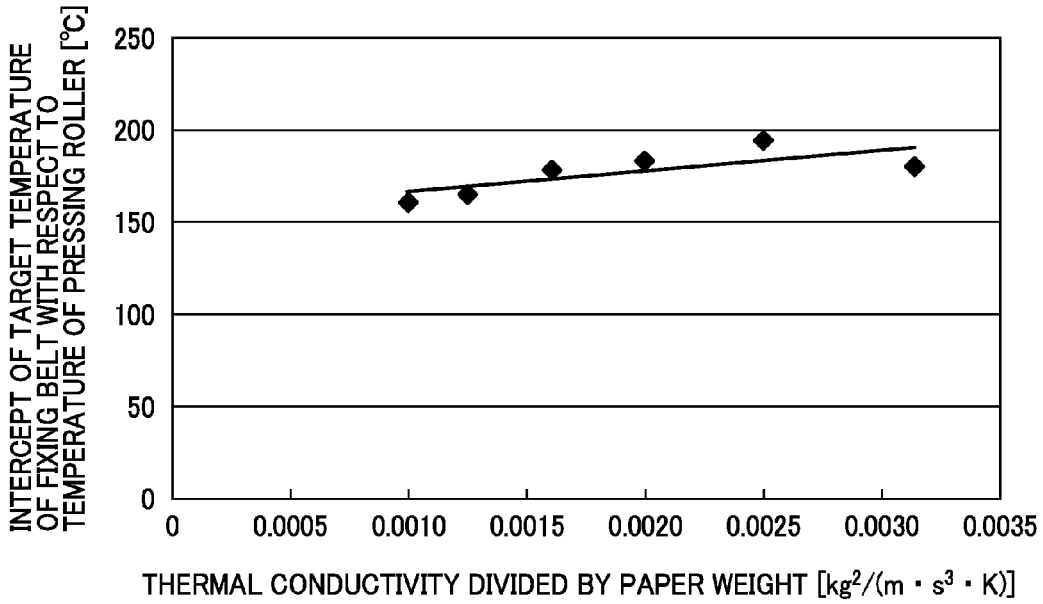
FIG. 29B is a graph showing a relation between the characteristic value obtained by dividing the thermal conductivity of the recording medium by the paper weight of the recording medium and the intercept of the target temperature of the fixing belt with respect to the temperature of the pressing roller.

FIG. 29A is a graph showing a relation between the characteristic value obtained by dividing the thermal conductivity of the recording medium 20 by the paper weight of the recording medium 20 and the gradient of the target temperature of the fixing belt 3 with respect to the temperature of the pressing roller 2. FIG. 29B is a graph showing a relation between the characteristic value obtained by dividing the thermal conductivity of the recording medium 20 by the paper weight of the recording medium 20 and the intercept of the target temperature of the fixing belt 3 with respect to the temperature of the pressing roller 2. The nip conveyance time was 50 ms. The specific heat of the recording medium 20 was 1,012 KJ/(m$^3$·K). The moisture content of the recording medium 20 was 4 percent. As shown in FIGS. 29A and 29B, the greater the characteristic value obtained by dividing the thermal conductivity of the recording medium 20 by the paper weight of the recording medium 20, the smaller the gradient of the target temperature of the fixing belt 3 with respect to the temperature of the pressing roller 2. That is, the greater the characteristic value, the smaller the effect of the temperature of the pressing roller 2 on the temperature of the recording medium 20 discharged from the fixing nip N. Such relation is obvious from the results of the thermal conductivity shown in FIG. 25 and the paper weight shown in FIG. 24. Since the effect of the temperature of the pressing roller 2 on the temperature of the recording medium 20 discharged from the fixing nip N is corrected by using the characteristic value, data about the gradient of the target temperature of the fixing belt 3 with respect to the temperature of the pressing roller 2 that varies depending on the characteristic value is obtained in advance by experiment or simulation as shown in FIG. 29A. Using the data, the gradient of the line indicating the relation between the target temperature of the pressing roller 2 and the target temperature of the fixing belt 3 is obtained. Further, based on the obtained gradient, the target temperature of the fixing belt 3 corresponding to the temperature of the pressing roller 2 is obtained. Based on the obtained target temperature of the fixing belt 3, the fixing temperature controller 92*a* performs feedback control, approximating the temperature of the recording medium 20 discharged from the fixing nip N to a target temperature.

Like the correction control method using one of the five properties described above, the target temperature of the fixing belt 3 is also controlled with a correction control method by combination of two of the five properties, thus heating the recording medium 20 discharged from the fixing nip N to a target temperature.

As described above, the correction calculation of the temperature of the recording medium 20 discharged from the fixing nip N based on the temperature of the pressing roller 2 uses at least two of the five properties as information of the recording medium 20, that is, the nip conveyance time, the paper weight, the thermal conductivity, the specific heat, and the moisture content of the recording medium 20. Accordingly, compared to a method using one of the five properties, an amount of heat supplied from the heaters of the halogen heater set 5 (e.g., the first halogen heater 5*a*, the second halogen heater 5*b*, and the third halogen heater 5*c* depicted in FIG. 3) and the resistance heat generator set 5S (e.g., the resistance heat generators 5Sa to 5Sh depicted in FIG. 4) is calculated precisely, achieving a substantially constant, high quality fixing and reducing energy consumption of the fixing device 22.

Similarly, the target temperature of the fixing belt 3 is also controlled with a correction control method by combination of three or more of the five properties that creates the characteristic value.

The above-described correction calculation of the target temperature of the fixing belt 3 is not performed in a particular span in an axial direction of the fixing belt 3. For example, the correction calculation is performed for the plurality of heaters (e.g., the first halogen heater 5*a*, the second halogen heater 5*b*, and the third halogen heater 5*c* depicted in FIG. 3 and the resistance heat generators 5Sa to 5Sh depicted in FIG. 4) aligned in the longitudinal direction of the heating roller 4 independently according to image information, that is, the image area of the toner image T on the recording medium 20. Accordingly, the temperature of the fixing belt 3 is adjusted precisely for each axial heating span (e.g., the first axial heating span a, the second axial heating span b, and the third axial heating span c depicted in FIG. 3 and the axial heating spans Sa to Sh depicted in FIG. 4) on the fixing belt 3 that corresponds to the image area of the toner image T on the recording medium 20. Hence, the correction calculation for correcting the target temperature of the recording medium 20 discharged from the fixing nip N is performed for each heater (e.g., the first halogen heater 5*a*, the second halogen heater 5*b*, and the third halogen heater 5*c* depicted in FIG. 3 and the resistance heat generators 5Sa to 5Sh depicted in FIG. 4) disposed opposite the corresponding, axial heating span (e.g., the first axial heating span a, the second axial heating span b, and the third axial heating span c depicted in FIG. 3 and the axial heating spans Sa to Sh depicted in FIG. 4). Consequently, the temperature of the fixing belt 3 is adjusted precisely according to image information such as an amount of toner adhered to the recording medium 20 and whether or not the toner image T is formed on a particular axial span on the recording medium 20, improving fixing quality and reducing energy consumption of the fixing device 22.

With reference to FIGS. 2 and 3, a description is provided of advantages of the fixing device 22 performing the fixing device temperature control method involving the correction control method described above.

The fixing device 22 includes a fixing rotary body (e.g., the fixing belt 3) contacting and heating a first side of a recording medium 20 that bears an unfixed toner image T; a pressing rotary body (e.g., the pressing roller 2) pressed against the fixing rotary body to form the fixing nip N therebetween through which the recording medium 20 is conveyed as the pressing rotary body contacts a second side of the recording medium 20 and presses the recording medium 20 against the fixing rotary body; a plurality of heaters (e.g., the first halogen heater 5*a*, the second halogen heater 5*b*, and the third halogen heater 5*c* depicted in FIG. 3 and the resistance heat generators 5Sa to 5Sh depicted in FIG. 4) aligned in a longitudinal direction of the fixing rotary body to heat the fixing rotary body; and the temperature detector (e.g., the temperature sensor 7) disposed opposite the pressing rotary body to detect a temperature of the pressing rotary body. The fixing device 22 performs a fixing device temperature control method to control by feedback the target temperature of the fixing rotary body based on the temperature of the pressing rotary body detected by the temperature detector. The fixing device temperature control method further selectively energizes at least one of the plurality of heaters according to the image area on the recording medium 20 where the toner image T is formed on the recording medium 20 so as to heat the image area on the recording medium 20 to a target temperature when the recording medium 20 is discharged from the fixing nip N.

The fixing device temperature control method controls the temperature of the image area on the recording medium 20 discharged from the fixing nip N to a target temperature.

Accordingly, the fixing device temperature control method substantially maintains quality of the toner image T fixed on the recording medium 20 and prevents overheating of the recording medium 20 and the toner image T formed thereon, reducing energy consumption of the fixing device 22. Further, the plurality of heaters is selectively energized to heat the image area on the recording medium 20, reducing wasted energy that may be used to heat a non-image area on the recording medium 20.

Figure 30:
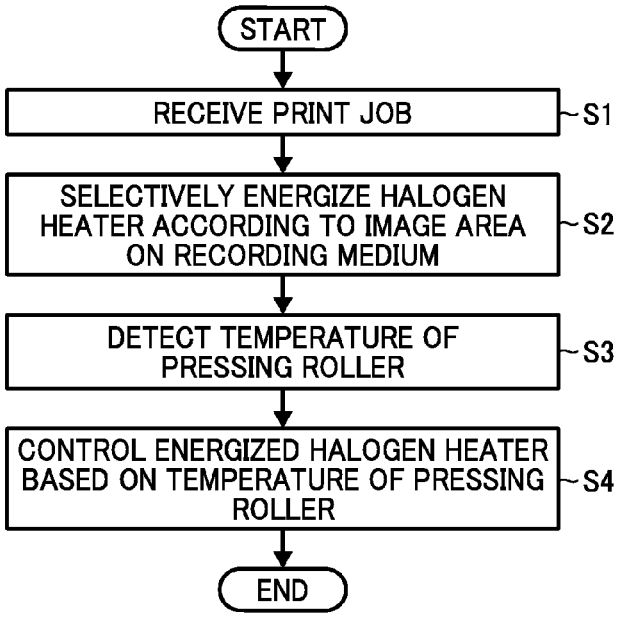
FIG. 30 is a flowchart illustrating a first example of control processes of the fixing device temperature control method according to the example embodiment.

With reference to FIG. 30, a description is provided of a first example of control processes of the fixing device temperature control method described above with reference to FIGS. 2 to 4 and 19B.

FIG. 30 is a flowchart illustrating the first example of the control processes of the fixing device temperature control method. As shown in FIG. 30, in step S1, the image forming apparatus 400 depicted in FIG. 1 receives a print job. In step S2, the fixing temperature controller 92*a* causes the PWM drive circuit 92*b* to selectively energize at least one of the first halogen heater 5*a*, the second halogen heater 5*b*, and the third halogen heater 5*c* of the halogen heater set 5 according to the image area on the recording medium 20 where the toner image T is formed on the recording medium 20. In step S3, the temperature sensor 7 detects the temperature of the pressing roller 2 and sends information about the detected temperature to the fixing temperature controller 92*a*. In step S4, the fixing temperature controller 92*a* controls the energized, at least one of the first halogen heater 5*a*, the second halogen heater 5*b*, and the third halogen heater 5*c* through the PWM drive circuit 92*b* based on the temperature of the pressing roller 2 detected by the temperature sensor 7 to heat the fixing belt 3 to the target temperature, thus heating the image area on the recording medium 20 discharged from the fixing nip N to the target temperature.

Figure 31:
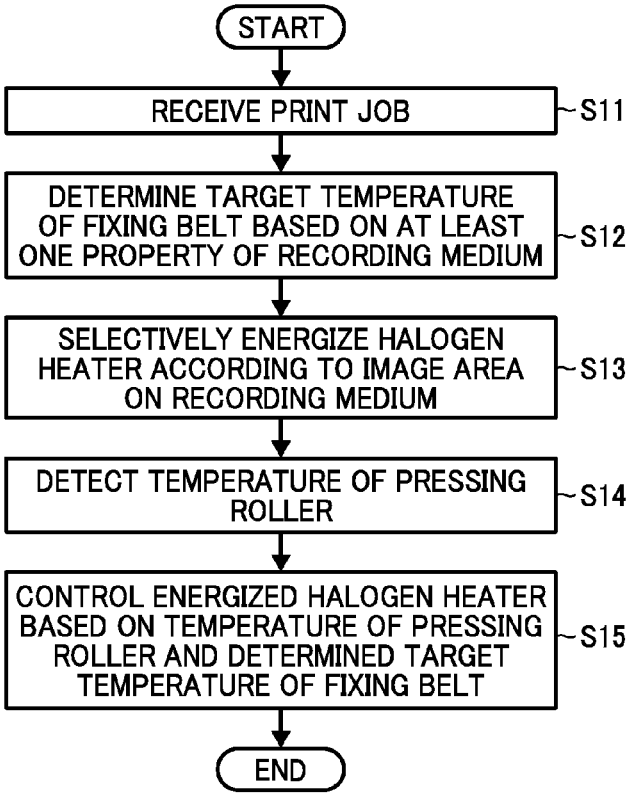
FIG. 31 is a flowchart illustrating a second example of control processes of the fixing device temperature control method according to the example embodiment.

With reference to FIG. 31, a description is provided of a second example of control processes of the fixing device temperature control method described above with reference to FIGS. 2 to 4 and 22 to 27.

FIG. 31 is a flowchart illustrating the second example of the control processes of the fixing device temperature control method. As shown in FIG. 31, in step S11, the image forming apparatus 400 depicted in FIG. 1 receives a print job. In step S12, the fixing temperature controller 92*a* depicted in FIG. 2 determines the target temperature of the fixing belt 3 based on at least one property of the recording medium 20, that is, at least one of the nip conveyance time, the paper weight, the thermal conductivity, the specific heat, and the moisture content of the recording medium 20. In step S13, the fixing temperature controller 92*a* causes the PWM drive circuit 92*b* to selectively energize at least one of the first halogen heater 5*a*, the second halogen heater 5*b*, and the third halogen heater 5*c* of the halogen heater set 5 according to the image area on the recording medium 20 where the toner image T is formed on the recording medium 20. In step S14, the temperature sensor 7 detects the temperature of the pressing roller 2 and sends information about the detected temperature to the fixing temperature controller 92*a*. In step S15, the fixing temperature controller 92*a* controls the energized, at least one of the first halogen heater 5*a*, the second halogen heater 5*b*, and the third halogen heater 5*c* through the PWM drive circuit 92*b* based on the temperature of the pressing roller 2 detected by the temperature sensor 7 and the target temperature of the fixing belt 3 determined based on the at least one property of the recording medium 20 to heat the fixing belt 3 to the target temperature, thus heating the image area on the recording medium 20 discharged from the fixing nip N to the target temperature.

It is to be noted that the control processes of the fixing device temperature control method shown in FIGS. 30 and 31 are also applicable to the fixing device 22S depicted in FIG. 4 that incorporates the resistance heat generator set 5S instead of the halogen heater set 5.

The example embodiments described above may be modified. For example, the number and arrangement of heaters of the halogen heater set 5 and the resistance heat generator set 5S are not limited to those shown in FIGS. 3 and 4. Further, the halogen heater set 5 and the resistance heat generator set 5S may be situated outside the heating roller 4 or the fixing devices 22 and 22S may employ an induction heater. According to the example embodiments described above, the fixing belt 3 is used as a fixing rotary body that contacts and heats the recording medium 20. Alternatively, a fixing roller, a fixing film, or the like, that contacts and heats the recording medium 20, may be used as a fixing rotary body. Further, the pressing roller 2 serves as a pressing rotary body. Alternatively, a pressing belt or the like may be used as a pressing rotary body.

The image forming apparatus 400 may employ a revolver method to form a toner image instead of a tandem method shown in FIG. 1. The image forming apparatus 400 according to the example embodiments described above uses four colors of toner. Alternatively, the image forming apparatus 400 may use three colors of toner to form a full-color toner image, two colors of toner to form a multi-color toner image, or a single color of toner to form a monochrome toner image.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device temperature control method, comprising:

selectively energizing, via a fixing temperature controller, at least one of a plurality of heaters according to an image area on a recording medium where a toner image is formed on the recording medium, the image area corresponding to a plurality of axial heating spans on a fixing rotary body;

detecting, via a temperature detector, a temperature of a pressing rotary body;

changing, via the fixing temperature controller, a target temperature of the fixing rotary body based on the detected temperature of the pressing rotary body so that a temperature of the image area is substantially constant among a plurality of recording media conveyed through a fixing nip formed between the fixing rotary body and the pressing rotary body continuously; and controlling, via the fixing temperature controller, at least one of the energized plurality of heaters during a print job for forming the toner image on the plurality of recording media continuously so as to maintain the image area on the recording medium at a substantially constant temperature when the recording medium is discharged from the fixing nip.

2. The fixing device temperature control method according to claim 1, wherein controlling at least one of the energized plurality of heaters maintains the temperature of the image area on the recording medium discharged from the fixing nip to within 5 degrees centigrade of the target temperature.

3. The fixing device temperature control method according to claim 1, wherein controlling at least one of the energized plurality of heaters includes correcting the target temperature of the fixing rotary body using at least one property of the recording medium.

4. The fixing device temperature control method according to claim 3, wherein the at least one property includes a nip conveyance time for which the recording medium is conveyed through the fixing nip and a paper weight, a thermal capacity, a specific heat, and a moisture content of the recording medium.

5. The fixing device temperature control method according to claim 3, wherein correcting the target temperature of the fixing rotary body using at least one property of the recording medium is performed for each heater according to the image area on the recording medium disposed opposite the heater.

6. A fixing device comprising:

a fixing rotary body contacting and heating an unfixed toner image formed on a recording medium;

a plurality of heaters aligned in a longitudinal direction of the fixing rotary body to heat the fixing rotary body and disposed opposite a plurality of axial heating spans on the fixing rotary body, respectively;

a pressing rotary body pressed against the fixing rotary body to form a fixing nip between the fixing rotary body and the pressing rotary body through which the recording medium is conveyed;

a plurality of non-contact temperature detectors disposed opposite to each respective plurality of heaters to detect a temperature of the fixing rotary body;

a temperature detector to detect a temperature of the pressing rotary body, a drive circuit connected to the plurality of heaters to energize the plurality of heaters; and a fixing temperature controller operatively connected to the drive circuit to control the drive circuit to selectively energize at least one of the plurality of heaters according to an image area on the recording medium where the toner image is formed on the recording medium, the image area corresponding to the plurality of axial heating spans on the fixing rotary body, the fixing temperature controller to change a target temperature of the fixing rotary body based on the detected temperature of the pressing rotary body so that a temperature of the image area is substantially constant among a plurality of recording media conveyed through the fixing nip formed between the fixing rotary body and the pressing rotary body continuously, and control at least one of the energized plurality of heaters during a print job for forming the toner image on the plurality of recording media continuously so as to maintain the image area on the recording medium at a substantially constant temperature when the recording medium is discharged from the fixing nip.

7. The fixing device according to claim 6, wherein the plurality of axial heating spans on the fixing rotary body corresponds to a plurality of sizes of recording media.

8. The fixing device according to claim 6, wherein the fixing rotary body includes an endless fixing belt.

9. The fixing device according to claim 6, wherein the pressing rotary body includes a pressing roller.

10. The fixing device according to claim 6, wherein the heater includes a halogen heater.

11. The fixing device according to claim 6, wherein the heater includes a resistance heat generator.

12. An image forming apparatus comprising the fixing device according to claim 6.

13. The fixing device temperature control method according to claim 1, further comprising operatively connecting the non-contact temperature detectors to control power supplied to the plurality of heaters.

14. The fixing device temperature control method according to claim 13, wherein controlling at least one of the energized plurality of heaters is based on a difference between a specific target temperature of the fixing rotary body and the temperature of the fixing rotary body detected by the plurality of non-contact temperature detectors.

15. The fixing device according to claim 6, wherein each of the plurality of heaters is aligned on a single longitudinal plane.

16. The fixing device according to claim 6, wherein the fixing temperature controller is a pulse width modulation (PWM) drive circuit.

* * * * *